US006210276B1

(12) United States Patent
Mullins

(10) Patent No.: US 6,210,276 B1
(45) Date of Patent: Apr. 3, 2001

(54) GAME WITH MULTIPLE INCENTIVES AND MULTIPLE LEVELS OF GAME PLAY AND COMBINED LOTTERY GAME WITH TIME OF PURCHASE WIN PROGRESSIVE JACKPOT

(76) Inventor: Wayne L. Mullins, 2937 E. Nisbet Ct., Phoenix, AZ (US) 85032

( * ) Notice: Subject to any disclaimer, the term of this patent is extended or adjusted under 35 U.S.C. 154(b) by 0 days.

(21) Appl. No.: 09/139,459

(22) Filed: Aug. 25, 1998

(51) Int. Cl.[7] ..... A63F 1/00
(52) U.S. Cl. ..... 463/27; 463/17; 463/26
(58) Field of Search ..... 463/16–19, 12, 463/13, 22, 25–29, 39–42; 273/292, 138.1, 138.2, 139, 138 A

(56) References Cited

U.S. PATENT DOCUMENTS

| | | | | |
|---|---|---|---|---|
| 5,092,598 | * | 3/1992 | Kamille | 273/139 |
| 5,158,293 | | 10/1992 | Mullins | 273/139 |
| 5,186,463 | * | 2/1993 | Marin et al. | 463/17 |
| 5,393,057 | * | 2/1995 | Marnell, II | 273/269 |
| 5,628,684 | * | 5/1997 | Bouedec | 273/138.2 |
| 6,019,374 | * | 2/2000 | Breeding | 273/292 |

* cited by examiner

*Primary Examiner*—Michael O'Neill
*Assistant Examiner*—S. Clayton
(74) *Attorney, Agent, or Firm*—Felsman, Bradley, Vaden, Gunter & Dillon, LLP

(57) ABSTRACT

A game 5 or 5A with multiple incentives and multiple levels. The game 5 or 5A has a first level 10 of game play with win opportunities that provides incentive to a player to play the game 5 or 5A and at least a second level 20 of game play with win opportunities that provides further incentive to the player to play the game. Contingencies of the first level 10 of game play need to be satisfied in order to enter and play the at least second level 20 of game play. The player 9 plays the first level 10 and the at least second level 20 of game play and wins accordingly only if the contingencies in the first level 10 of game play have been met by the player in order to play the at least second level 20 of game play. Otherwise, the player 9 only plays the first level 10 of game play and wins accordingly. Various game components are used to implement and play the game 5 or 5A. A game table 170 or 170A with lottery wager areas 6, 7, and 8, jackpot wager areas 16, 17, and 18, and jackpot retaining areas 22, 24, and 26 is provided. A light and sensor component 240 is located at each of the lottery wager areas and the jackpot wager areas. A wager activation switch 185 is coupled to each light and sensor component 240 wherein the switch 185 is activated to light up the respective areas when a chip is sensed thereon. A ticket vault and dispenser 177, a bar code reader 178, a computer 176, a dealer monitor 179, and a player monitor 190 or 190A are used with the game table 170 or 170A. The games of skill or chance or both are used with the game 5 or 5A may be a lottery ticket game, a jackpot game, etc. A combined lottery game 108 with time of purchase win progressive jackpot 222, 224, or 226 is disclosed. The lottery ticket game 108 has at least one instant win game, at least one progressive win game, and corresponding play and winning indices printed thereon. The second level jackpot game may be a high lottery ticket game, a playing card game, a dice game, etc.

35 Claims, 20 Drawing Sheets

| 6A | 6B |
|---|---|

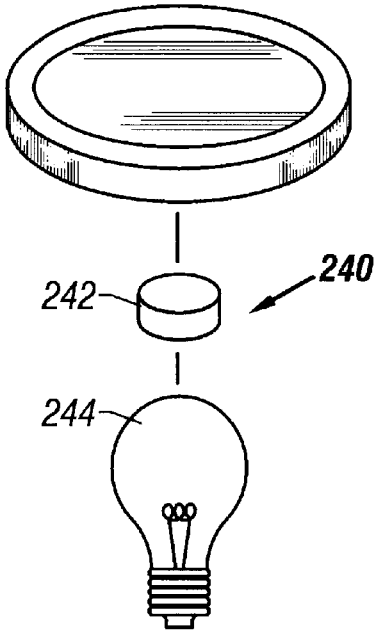
FIG. 14A
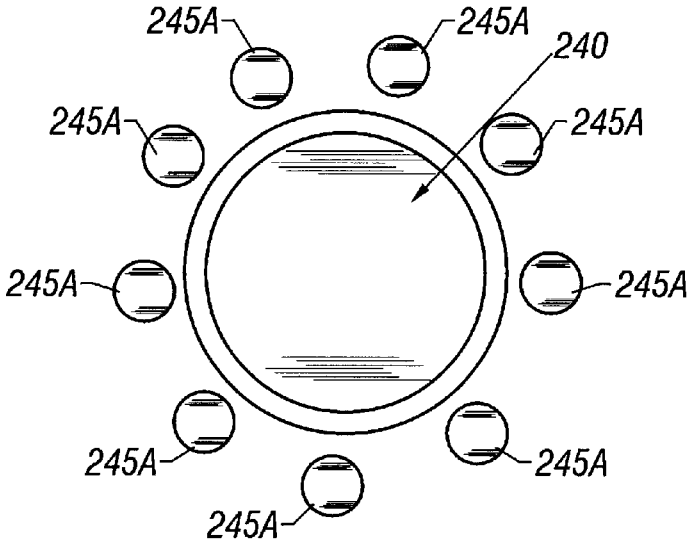
FIG. 14B
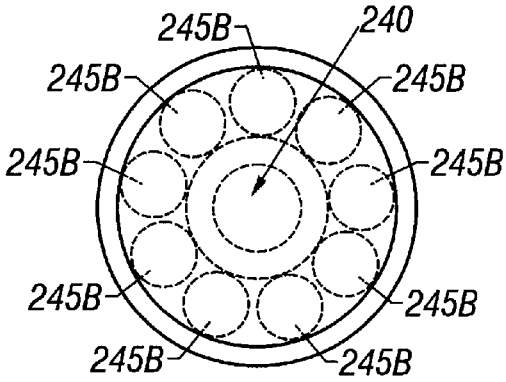
FIG. 14C
| | |
|---|---|
| Yellow | 1 |
| Blue | 2 |
| Green | 3 |
| Red | 5 |
| Brown | 10 |
| Gray | 15 |
| Pink | 20 |
| Purple | 25 |
| Orange | 100 |
247
FIG. 14D

GAME WITH MULTIPLE INCENTIVES AND MULTIPLE LEVELS OF GAME PLAY AND COMBINED LOTTERY GAME WITH TIME OF PURCHASE WIN PROGRESSIVE JACKPOT

FIELD OF INVENTION

The present invention relates to games, and in particular, to a game with multiple incentives and multiple levels of game play, a game that combines small win incentives with large win incentives, and a combined lottery game having an instant win game(s) and a time-of-purchase win progressive game(s).

BACKGROUND OF INVENTION AND BRIEF DESCRIPTION OF THE PRIOR ART

A number of games and gaming apparatuses and methods exist in the prior art. Various games of skill or chance are used in casinos and gambling halls. Some of these games of skill or chance involve playing card games, dice games, roulette wheels, etc. Other games of skill or chance involve lottery tickets in which a person purchases a lottery ticket in hoping that he/she will win an instant amount or a jackpot amount.

Lottery tickets contain either instant win/jackpot games or progressive jackpot games. In the instant win/jackpot games, the player purchases an instant lottery ticket and plays the game on the instant lottery ticket. The player at that time knows whether he/she is a winner and knows how much he/she has won. For progressive jackpot lottery games, the player purchases the progressive lottery ticket for a particular draw time and date and then waits until that time and date of the draw when the numbers are picked. After the draw for the progressive lottery jackpot game, the player knows whether he/she is a winner and knows how much he/she has won. Instant lottery games are played separately from the jackpot play type jackpots, that is, instant tickets lottery are sold entirely separately from progressive lottery tickets. Therefore, the player either is playing for the typically fixed, smaller amount wins if he/she is playing the instant lottery games, and the player is playing for the larger, progressive amount wins if he/she is playing the progressive lottery games.

Lottery ticket games that combine both instant win/jackpot games and progressive jackpot games on single tickets have been developed. U.S. Pat. No. 5,158,293 to Mullins ("Mullins") discloses an example of such a combination lottery ticket and game. This prior art patent is incorporated by reference herein. Mullins discloses the combination of an instant play type lottery game with a jackpot type lottery game. The instant type lottery game may be any of one instant type lottery game. The progressive lottery jackpot game is one that the player has a ticket that has a series of numbers from a field of numbers from which the winning numbers will be drawn. The winning numbers are selected at random on a specified drawing date for that ticket. On the specified date, the winning numbers are drawn from the field of numbers. Any ticket with the winning numbers is a winning ticket, and the holder of a winning ticket is entitled to at least a share or all of the jackpot.

One drawback for the players of the progressive lottery jackpot games is that the players have to wait until the specified drawing date before they find out whether they have a winning ticket. Therefore, players are not able to win the progressive jackpot at the time and date which they purchase a ticket, and they can only win after the drawing on the specified date and time. Furthermore, another drawback with this type of progressive lottery jackpot game is that it generally requires lottery officials to monitor and determine (i.e. draw the winning numbers and monitor/verify the winning tickets) the winning players having winning tickets. Since the specified drawing date only occurs on a per time period/frequency basis, then the jackpot is limited to only rolling over when there is no winning ticket on this time period/frequency basis as well. In other words, a continuous progressive jackpot that can be won at any time that a ticket is purchased and that is monitored and tracked and initially reset again by a computer(s) does not exist. Therefore, the needs and desires exist to provide a ticket with a combination instant lottery game and progressive lottery game wherein the progressive lottery game provides a continuous progressive jackpot that can be won at any time a ticket is purchased. The needs and desires also exist to provide the capabilities of monitoring and tracking the winning ticket(s) and accordingly resetting the jackpot.

Therefore, most games of skill or chance provide players with a smaller jackpot (i.e. such as a table jackpot) as being the incentive to play those games while other games of skill or chance provide players with a larger jackpot (i.e. such as a progressive jackpot) as being the incentive to play these games. The games that presently exist provide for either one of these types of jackpot (i.e. either the game is for a smaller jackpot or for a larger jackpot). Each of these respective games provide various levels of incentive to play these games. Depending on player choice and risk decisions, a player will play one type of game over another type of game. In other words, a player faces the choice of playing for smaller jackpots if the player wants a higher chance of winning at least some jackpot amount(s). On the other hand, a player faces the choice of playing for larger jackpots if the player wants the opportunity to win a larger amount but is willing to take the high possibility risk of losing almost every time he/she plays. Therefore, the incentive levels of each of these two types of games have been separated, and when each of these games have been played, then no further play and no further incentive exists for the player. Therefore, some players opt not to play some games at all since these games are all or nothing win opportunity games and since they do not provide the additional incentives, drive, and fun for the players in order to keep their interests for continuing to play these games.

Therefore, the needs and desires exists for providing a game that provides the player with additional play and additional incentive and for providing a game that provides the player with additional opportunities to win. Therefore, the demand for a game with multiple incentives and multiple levels of game play exists. Furthermore, the demand for a game that combines the incentives for playing smaller jackpot games with the incentives for playing larger jackpot games exists. Thus, the need and desire exist for providing a game that combines the incentives for playing smaller jackpot games with the incentives for playing larger jackpot games. Furthermore, the demand exists for providing a game wherein the smaller jackpot win amounts drive the play of the larger win amount game and the larger jackpot win amounts, in turn, drive the play of the smaller win amount game. Also, the needs and desires for providing a lottery game that combines instant win games with an instant win progressive jackpot game also exists.

SUMMARY OF INVENTION

Set forth is a brief summary of the invention in order to solve the foregoing problems and achieve the foregoing and other objects, benefits, and advantages in accordance with the purposes of the present invention as embodied and broadly described herein.

It is an object of the invention to provide more incentive, drive, and fun for players to play a game.

It is another object of the invention to provide a game that provides the player with additional play and additional incentive.

It is a further object of the invention to provide a game that provides the player with additional opportunities to win.

It is another object of the invention to provide a game with multiple incentives.

It is another object of the invention to provide a game with multiple levels of game play.

It is a further object of the invention to provide a game with multiple levels of game play wherein at least one level of game play drives at least another level of game play.

It is still a further object of the invention to provide a game with multiple levels of game play wherein the driving of one level of game play by another level of game play increases the play of the respective games at the levels of game play by the players.

It is still another object of the invention to provide a game with multiple levels of game play wherein instant win and progressive jackpot amounts may be won at a first level of play.

It is still a further object of the invention to provide a game with multiple levels of game play wherein a table jackpot amount may be won at a second level of play.

It is still a further object of the invention to provide a game with multiple levels of game play wherein a progressive jackpot amount may be won at a second level of play.

It is another object of the invention to provide a game that combines the incentives for playing smaller jackpot games with the incentives for playing larger jackpot games.

It is a further object of the invention to provide a game wherein the smaller jackpot win amounts drive the play of the larger win amount game and the larger jackpot win amounts, in turn, drive the play of the smaller win amount game.

It is also an object of the invention to provide a lottery game that combines instant win games with a time-of-purchase win progressive jackpot game.

It is a further object of the invention to provide a combination lottery ticket game in which the ticket has a combination instant lottery game and progressive lottery game and the progressive lottery game provides a continuous progressive jackpot that can be won at the time a ticket is purchased and that can be reset after a winning ticket has been purchased.

It is another object of the invention to provide the capabilities of monitoring and tracking the winning ticket(s) and accordingly resetting the jackpot for the continuous progressive jackpot of the combination lottery ticket game.

It is still another object of the invention to provide a game that allows continue of play and roll over and building of a larger jackpot(s) as more decks and deals of lottery tickets are added for play of the lottery game.

The above and other objects are achieved by a method of playing a game. A player enters and plays one level of game play that provides incentive to him/her to play the game and also enters and plays at least another level of game play that provides further incentive to him/her to play the game. The one level of game play is a first level of game play, and the other level of game play is a second level of game play. It is determined whether the player has decided to enter the second level of game play. The player plays the first level of game play and wins accordingly when the player decides only to play the first level of game play. It is determined whether the player has satisfied contingencies to play the second level of game play. The player plays only the first level of game play and wins accordingly if the contingencies to play the second level of game play have not been met by the player. The player plays the first level and second level of game play and wins accordingly if the contingencies to play the second level of game play have been met by the player. It is determined whether the player has decided to play the game again. The player starts the game again if the player has decided to play again and ends the game if the player has decided to quit playing the game. The player may play games of skill and chance such as a lottery ticket game or jackpot (i.e. table jackpot or progressive jackpot) game at the first and second levels of game play. The table jackpot game may be a highest lottery ticket game, a playing card game, a high/low card game, a twenty one card game, a poker card game, a dice game, or any other suitable game. The one level of game play may provide smaller win amounts and the other level of game play may provide larger win amounts. The game may be played in whole or in part electronically.

The above and other objects are further achieved by a method of playing a game having first and second or more levels of game play that are a lottery game. The smaller win amounts are instant win amounts for at least one instant win game of the lottery game, and the larger win amounts are progressive win amounts for at least one progressive win game of the lottery game. The instant win amounts are won by having particular winning indices on a lottery ticket for the at least one instant win game, and the progressive win amounts are won by having particular indices on a lottery ticket for the at least one progressive win game and the at least one instant win game. A number of lottery tickets are printed for a number of decks of the lottery tickets. Winning indices are printed on some of the lottery tickets for the at least one instant win game. At least one winning indices is printed on a lottery ticket within each of the decks of lottery tickets for the at least one progressive win game. At least one corresponding winning indices is randomly printed for the at least one instant win game of a lottery ticket having the at least one winning indices for the at least one progressive win game on a corresponding play line in determining a winner for the at least one progressive win game. A number of decks are provided for a deal of the lottery tickets. A progressive jackpot of the at least one progressive win game is allowed to continuously build as more decks and deals of the lottery tickets are added and sold to players. Respective win amounts are determined for the instant win amounts and the progressive win amounts to the players at time of purchase of the lottery tickets. The progressive jackpot is reset to an initial jackpot amount when the winner for the at least one progressive win game has been determined. The game may be played electronically.

The above and other objects are further achieved by a method of making a game with multiple incentives and multiple levels. At least one game and at least one win opportunity are defined for one level of game play that provides incentive to a player to play the game. At least another game and at least another win opportunity are defined for at least another level of game play that provides further incentive to the player to play the game. Corresponding game components are implemented for the one level and the another level of game play. Contingencies of the at least one game for the one level of game play in order to enter and play the at least another game for the at least another level of game play are defined. The at least one game and the at least another game are games of skill or chance such as a lottery ticket game, a jackpot game, etc. The jackpot game may be a table jackpot game is played among at least one player against the dealer or house or at least two players in which one player is determined a winner of a corresponding table jackpot amount. The table jackpot game may also be a progressive jackpot game that builds from the play of the table jackpot game wherein a winning player of the progressive jackpot game is determined by results of the lottery ticket game.

The above and other objects are further achieved by a game with multiple incentives and multiple levels. A first level game with win opportunities provides incentive to a player to play the game, and at least a second or more level game with win opportunities provides further incentive to the player to play the game. Game components are provided for implementing and playing the first and second or more level games. Contingencies of the first level game that need to be satisfied in order to enter and play the at least second or more level game are defined. The first and the at least second or more level games are games of skill and/or chance. The first level game of skill or chance is a lottery ticket game, and the at least second level game of skill or chance is at least one jackpot game. The third level game of skill or chance is at least one jackpot game. The lottery ticket game may include at least one instant win game that provides the player with at least one win opportunity for an instant win amount and at least one progressive win game that provides the player with at least one win opportunity for a progressive jackpot amount. The lottery ticket game may use a lottery ticket with the at least one instant win game, the at least one progressive win game, and the corresponding play and winning indices printed thereon. The at least one jackpot game is a playing card game, and the lottery ticket also has playing card indices printed thereon for play of the playing card game. A bar code for reading the play and winning indices on the lottery ticket and for monitoring and tracking a winning ticket and accordingly resetting the progressive jackpot amount is provided. A game table that comprises a lottery play area for allowing each of a number of players to play the lottery game and a jackpot game play area for allowing each of the players to play the at least one jackpot game and a jackpot area that retains chip amounts collected from the jackpot game play area from each of the players is also provided. The lottery play area comprises a number of lottery ticket purchases (wager) areas for each of the players, and the jackpot game play area comprises a number of jackpot wager areas for each of the players. A light and sensor component is located at each of the lottery wager and/or ante areas and the jackpot wager and/or ante areas. A wager/ante activation switch is coupled to each light and sensor component wherein the switch is activated to light up the lottery wager areas and the jackpot wager areas where a chip is sensed on one of the respective lottery wager areas and the respective jackpot wager areas. A flashing light component is coupled to the light and sensor component wherein a light feature of the light and sensor component is flashed at a respective winning lottery wager area and a respective jackpot wager area. Colored lights are located at the lottery wager areas and the jackpot wager areas where activation of the colored lights represent respective win amounts for the lottery ticket game. A ticket vault and dispenser for holding and dispensing the lottery tickets, a bar code reader for reading the lottery tickets as the lottery tickets are being dispensed, and a computer coupled to the ticket vault and dispenser and the bar code reader for monitoring and tracking play of the game are also provided. A dealer monitor may be coupled to the computer to allow a dealer to monitor and track play of the game, and a player monitor may be coupled to the computer to allow players and other viewers to view play of the game. The game components for implementing and playing the first and second or more level games may be fully electronic game components. These fully electronic game components may be electronic player units coupled together to a computer.

The preferred embodiments of the inventions are described below in the Figures and Detailed Description. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF DRAWINGS

FIG. 14A is an exploded view of the wager area device and the light and sensor feature for the play area device within the game table of the present invention multiple incentive/multiple level game.

FIG. 14B is a top view of the play area device and light and sensor feature of FIG. 14A further showing symbolic colored lights surrounding the wager area device.

FIG. 14C is a top view of the wager area device and light and sensor feature of FIG. 14A further showing symbolic colored lights surrounding the inner bulb within the play area device.

FIG. 14D is a chart of the color coding scheme representing the win amounts for instant win games.

DETAILED DESCRIPTION

Figure 1:
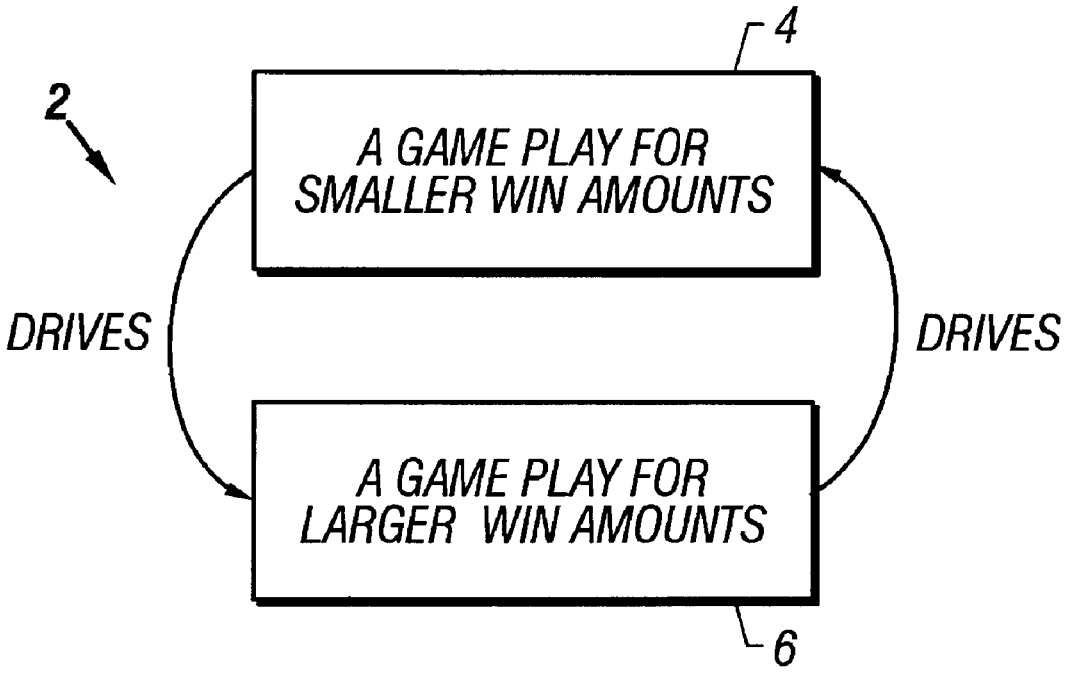
FIG. 1 is a block diagram showing a game with a game play for smaller win amounts driving a game play for larger win amounts and vice versa.

The present invention provides a game that multiple incentives and multiple levels of play. FIG. 1 discloses a game 2 that combines the possibility of winning both at a smaller level and a larger level. The game 2, therefore, involves interrelating, intermingling, and/or combining multiple incentives (i.e. the incentive of winning smaller amounts for a game play with the incentive of winning larger amounts for a game play). FIG. 1 shows that the game 2 involves a game play for smaller win amounts at block 4 which drives a game play for larger win amounts at block 6 since the possibility of a player winning smaller amounts provides incentive for the player to play the overall game 2. Conversely, the game play for the larger win amounts at block 6, in turn, drives the game play for the smaller win amounts at block 4 since the possibility of a player winning larger amounts also provides incentive for the player to play the overall game 2.

I. Game with Multiple Levels of Game Play

Figure 1A:
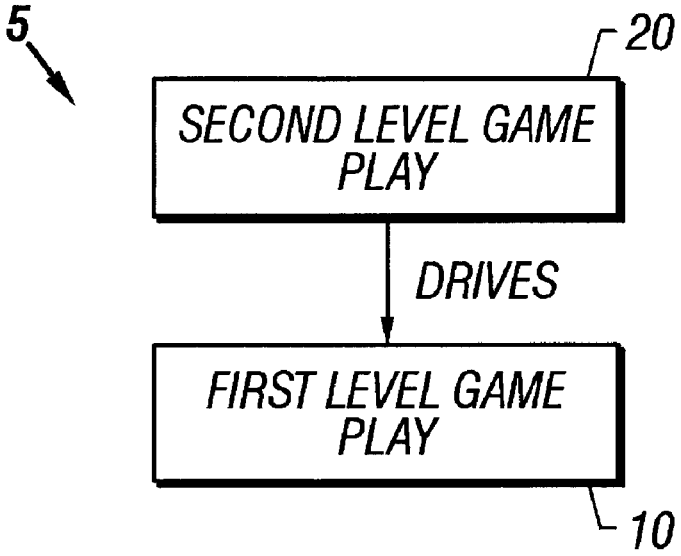
FIG. 1A is a block diagram showing a game where a second level of game play drives a first level of game play.

FIG. 1A shows the present invention game 5 that comprises multiple levels of game play wherein one or more level(s) of game play drives other level(s) of game play. FIG. 1A shows the game 5 having two levels of game play: a first level FIG. 10 of game play and a second level 20 of game play. FIG. 1A shows that the second level 20 of game play drives the first level 10 of game play. Additional levels of game play may be used with the present invention. The present invention game 5 is not in any way limited to any particular number of levels of game play, and any suitable number (i.e. multiple number) of levels of game play may be used with the present invention.

Figure 2:
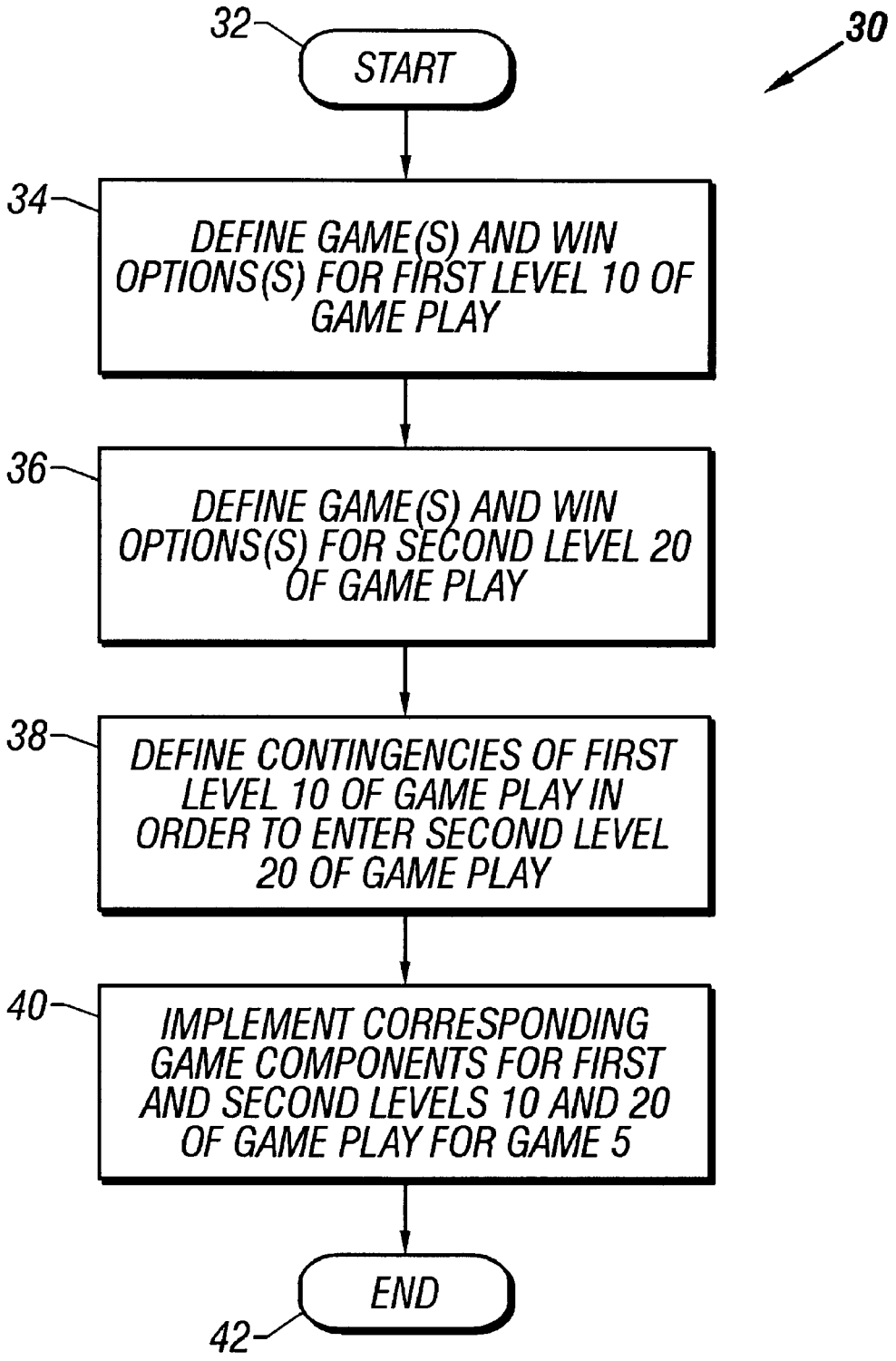
FIG. 2 is a flow chart diagram of a general method of making the present invention multiple incentive/multiple level game.

FIG. 2 shows a general method 30 of making the present invention game 5 having two levels (i.e. first level 10 and second level 20) of game play. The method 30 starts at block 32. At block 34, game(s) and win opportunity(ies) for the first level 10 of game play is/are defined. The method 30 moves to block 36 where game(s) and win opportunity(ies) for the second level 20 of game play is/are defined. Contingencies of the first level 10 of game play in order to enter the second level 20 of game play are defined at block 38. Game components are implemented for the first level 10 of game play and the second level 20 of game play at block 40. The method 30 of making game 5 ends at block 42. In these figures, the present invention game is shown to have two levels of game play: a first level 10 of game play and a second level 20 of game play. However, the present invention game 5 is not in any way limited to be made with any particular number of levels of game play, and any suitable number (i.e. multiple number) of levels of game play may be made for the present invention.

Figure 3:
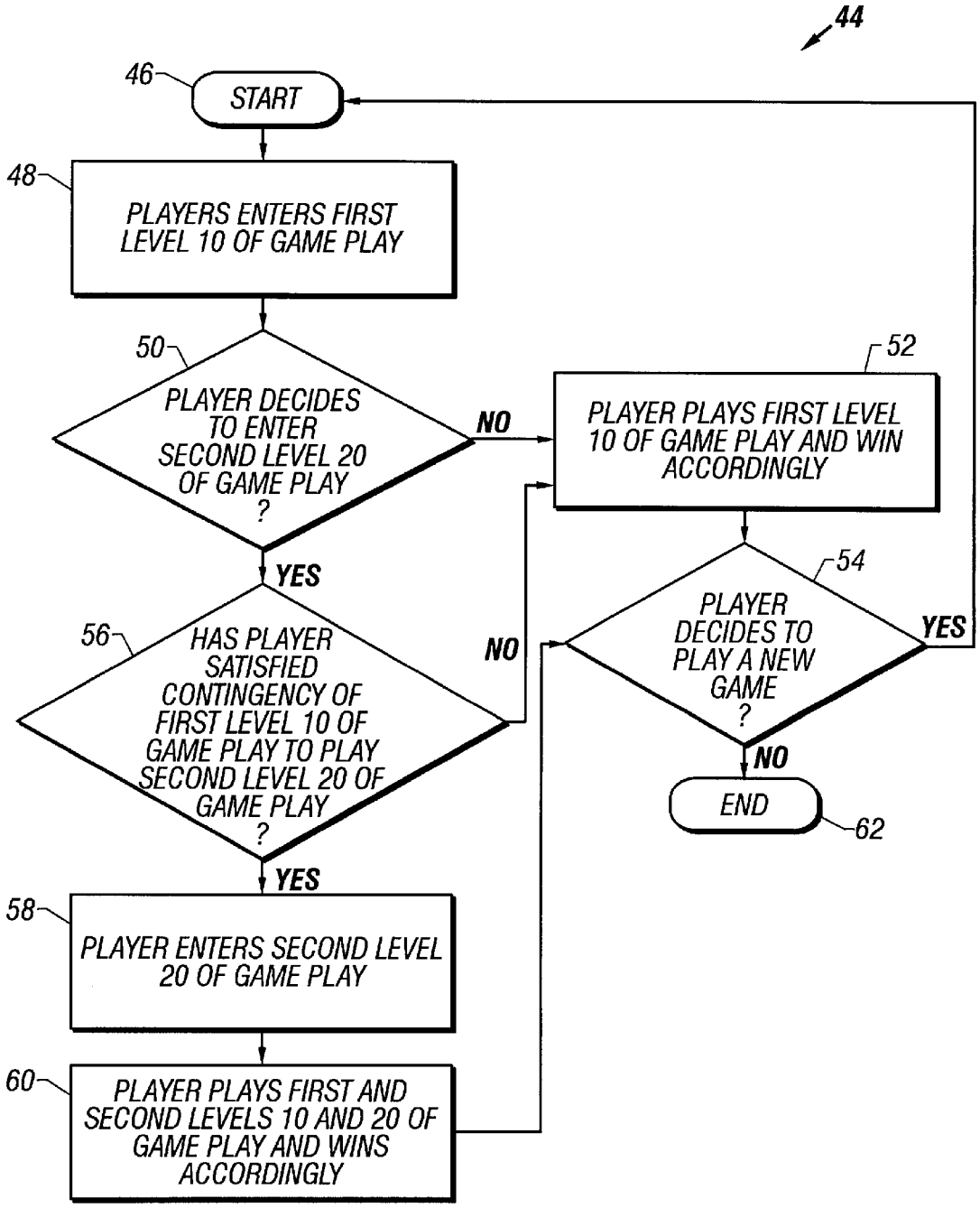
FIG. 3 is a flow chart diagram of a general method of playing the present invention multiple incentive/multiple level game of FIG. 2.

FIG. 3 shows a general method 44 of playing the game 5 made by method 30 of FIG. 2 having two levels of game play: a first level 10 of game play and a second level 20 of game play. The method 44 starts at block 46. The player enters the first level 10 of game play at block 48. At block 50, the player decides whether to enter the second level 20 of game play. If the player decides not to enter the second level 20 of game play, then the method 44 moves to block 52 where the player proceeds with playing the first level 10 of game play and wins accordingly. The player then decides whether he/she will play a new game 5 at block 54. If the player decides to play a new game 5 at block 54, then the method 44 loops back to the start block 46 where the player starts a new game 5. If the player decides not to play a new game 5, then the method 44 passes to block 62 where the player ends play of the game 5.

On the other hand, if at block 50 the player decides to enter the second level 20 of game play, then the method 44 moves to decision block 56 where the method 44 determines whether the player has satisfied the contingency(ies) of the first level 10 of game play in order to play the second level 20 of game play. If the player has not satisfied the contingency(ies), then the method 44 passes to block 52 where the player plays the first level 10 of game play and wins accordingly. The player then decides whether he/she will play a new game 5 at block 54. If the player decides to play a new game 5 at block 54, then the method 44 loops back to the start block 46 where the player starts a new game 5. If the player decides not to play a new game 5, then the method 44 passes to block 62 where the player ends play of game 5.

If the player has satisfied the contingency(ies) of the first level 10 of game play in order to play the second level 20 of game play, then the method 44 passes to block 58 where the player enters the second level 20 of game play. The player plays the first level 10 and the second level 20 of game play and wins accordingly at block 60. The method 44 then moves to block 54 where the player decides to play a new game 5. If the player decides to play a new game 5 at block 54, then the method 44 loops back to the start block 46 where the player starts a new game 5. If the player decides not to play a new game 5, then the method 44 passes to block 62 where the player ends play of game 5. These figures show the method 44 of playing the present invention game 5 having two levels of game play: a first level 10 of game play and a second level 20 of game play. However, the method of playing the present invention game 5 is not in any way limited to be played with any particular number of levels of game play, and the present invention game 5 may be played with any suitable number (i.e. multiple number) of levels of game play.

Figure 4:
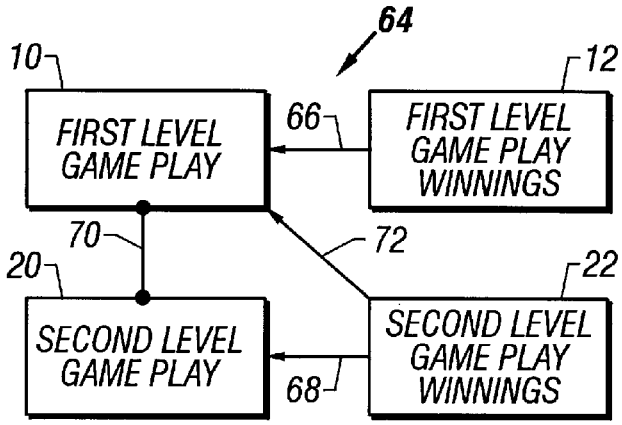
FIG. 4 is a block diagram showing the relationships between the first and second levels of game play and the respective winnings from each of these levels.

FIG. 4 shows the general relationship 64 between the winnings driving the respective levels of game play for the present invention game 5 shown in FIGS. 1A, 2, and 3. The relationship 64 shows that the first level game winnings 12 drive the play for the first level 10 of game play as shown by the arrow 66. FIG. 4 further shows that the second level game winnings 22 drive the play for the second level 20 of game play as shown by the arrow 68. As defined earlier by FIGS. 1A, 2, and 3, game 5 defines contingency(ies) of the first level 10 of game play that need(s) to be satisfied in order for the player to play the second level 20 of game play. Therefore, FIG. 4 shows that the first level 10 of game play is linked to the second level 20 of game play via line 70. Since the first level 10 is linked to the second level 20, then the second level game winnings 22 correspondingly and accordingly drives the play for the first level 10 of game play as well as shown by the arrow 72.

Figure 5:
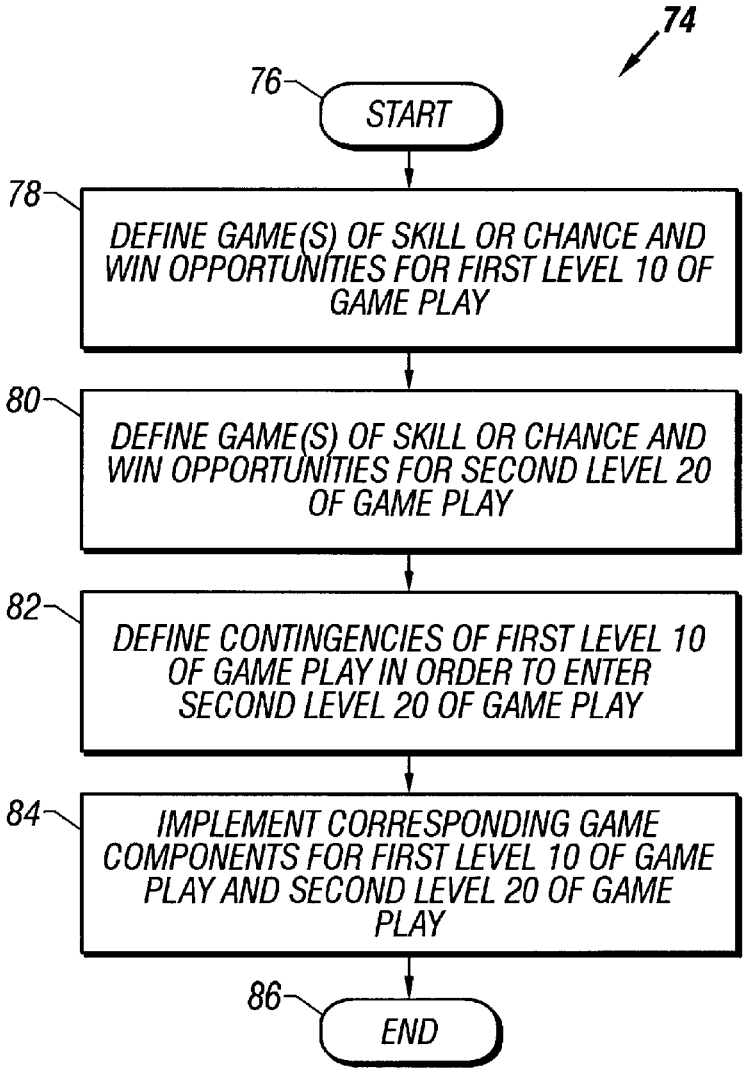
FIG. 5 is a flow chart diagram of a specific method of making the present invention multiple incentive/multiple level game.
Figures 6, 6A:
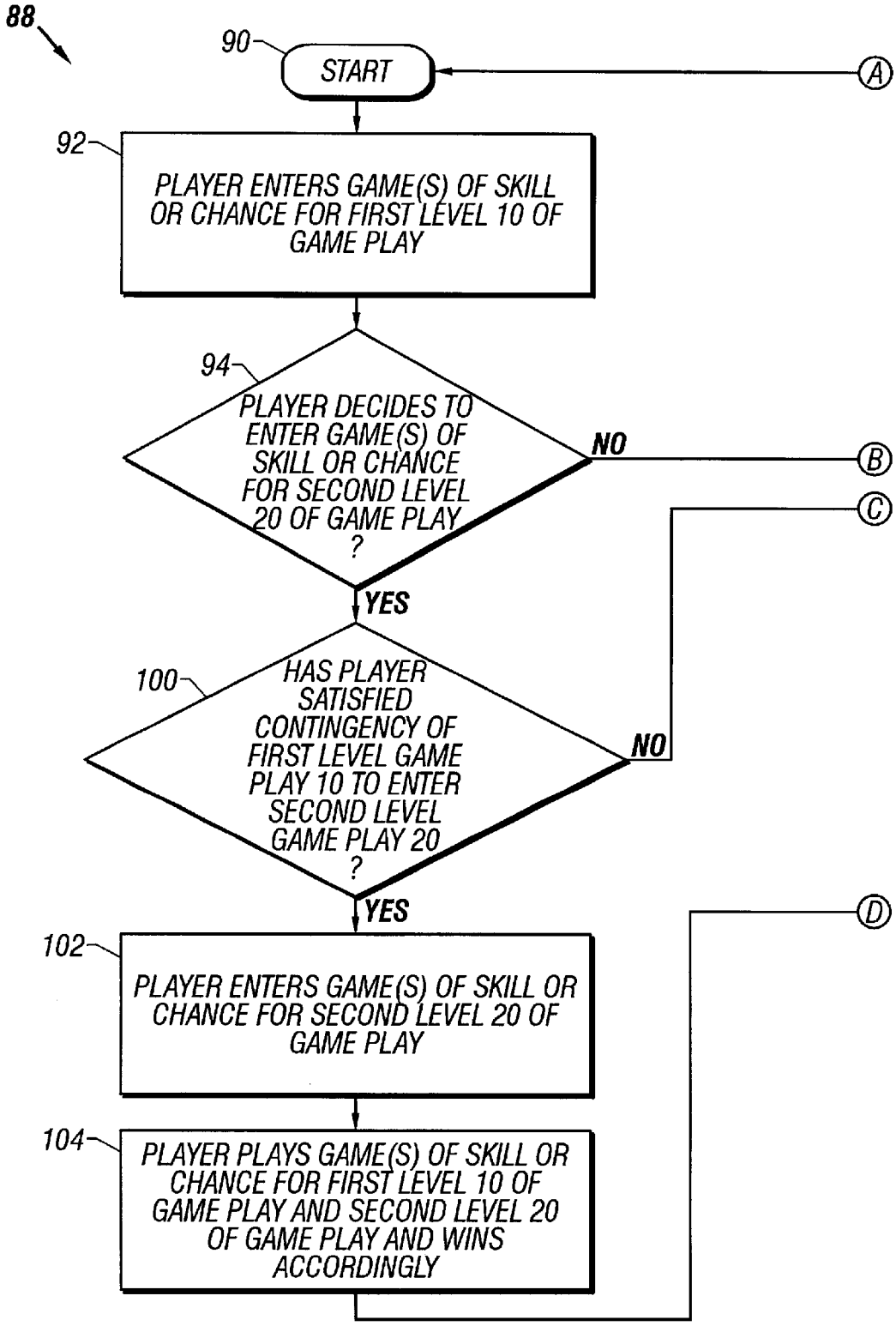
FIG. 6 is a flow chart diagram of a specific method of playing the present invention multiple incentive/multiple level game of FIG. 5.
Figure 6B:
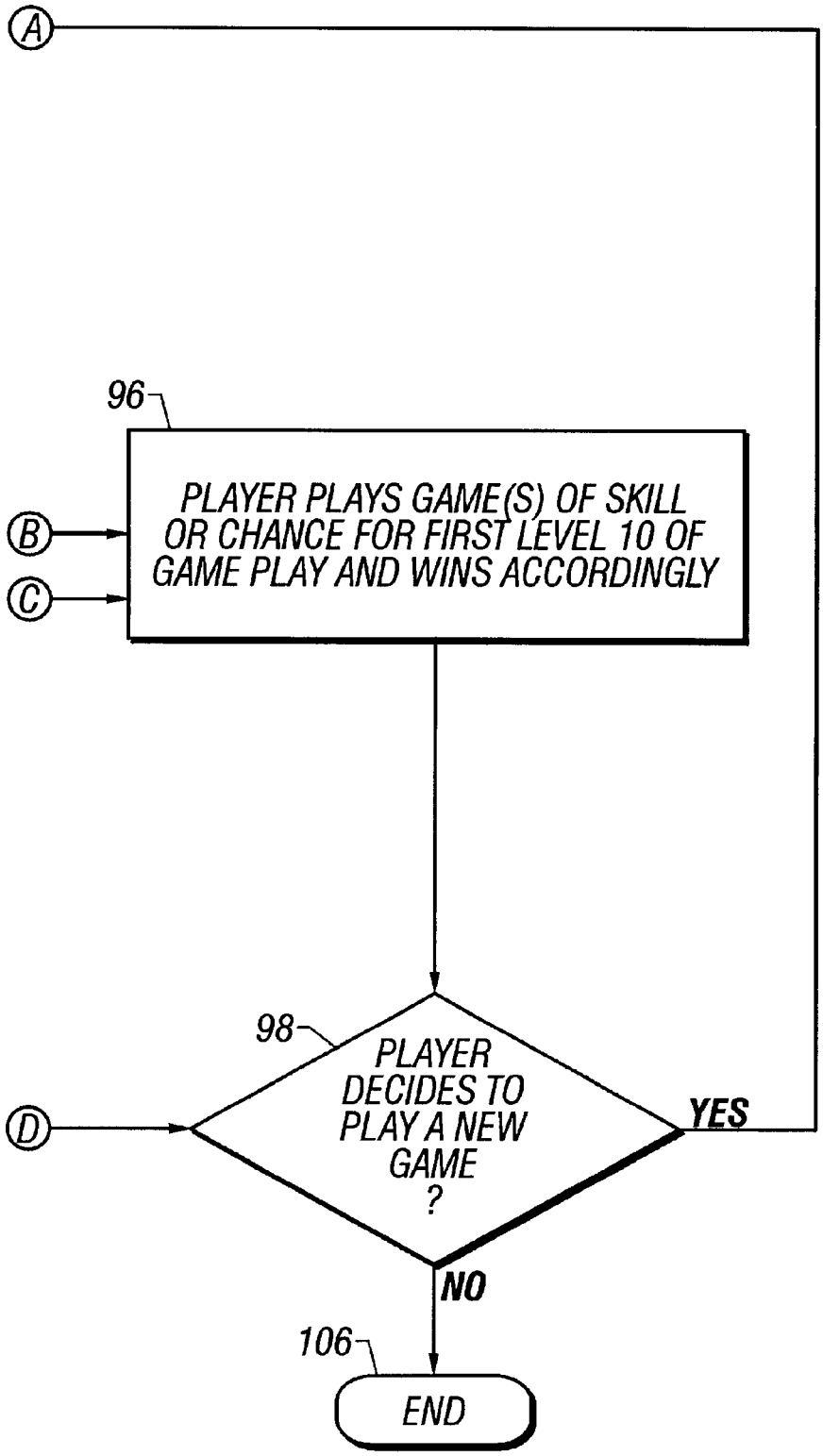

FIGS. 5 and 6 show a more specific method 74 of making and a more specific method 88 of playing the present invention game 5 wherein the first level 10 and second level 20 of game play comprise gambling games which include but are not limited to games of skill or chance and corresponding defined win opportunities. FIG. 5 shows that the method 74 of making the present invention game 5 starts at block 76. At block 78, game(s) of skill or chance and win opportunity(ies) for the first level 10 of game play is/are defined. The method 74 moves to block 80 where game(s) of skill or chance and win opportunity(ies) for the second level 20 of game play is/are defined. Contingencies of the first level FIG. 10 of game play in order to enter the second level 20 of game play are defined at block 82. Game components are implemented for the first level 10 of game play and the second level 20 of game play at block 84. The method 74 of making game 5 ends at block 86.

Figure 10:
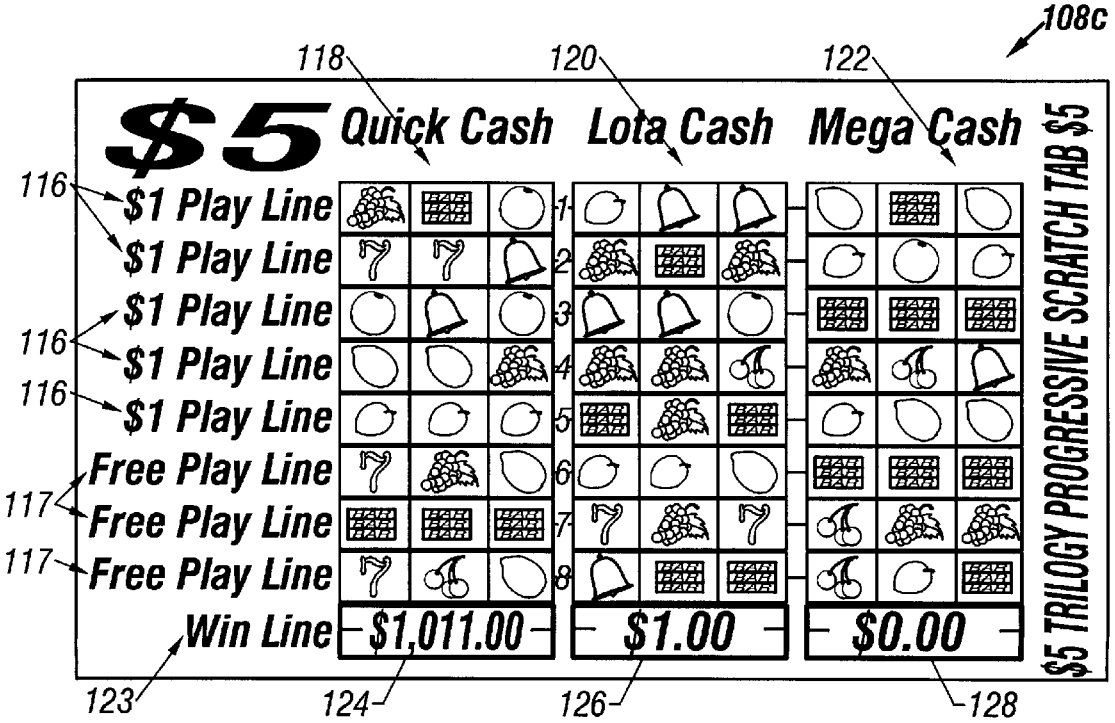
FIG. 10 is a front face of a five-dollar lottery ticket for the present TRILOGYυ lottery ticket game wherein the cover material has been removed and the playing indices are shown.

FIG. 6 shows a method 88 of playing the game 5 of FIG. 5 having two levels of game play: a first level FIG. 10 of game play and a second level 20 of game play wherein these two levels comprise games of skill or chance and corresponding defined win opportunities. The method 88 starts at block 90. The player enters the game(s) of skill or chance for the first level FIG. 10 of game play at block 92. At block 94, the player decides whether to enter the second level 20 of game play. If the player decides not to enter the second level 20 of game play, then the method 88 moves to block 96 where the player proceeds with playing game(s) of skill or chance at the first level 10 of game play and wins accordingly. The player then decides whether he/she will play a new game 5 at block 98. If the player decides to play a new game 5, then the method 88 loops back to the start block 90 where the player starts a new game 5. If the player decides not to play a new game 5, then the method 88 passes to block 106 where the player ends play of the game 5.

On the other hand, if at block 94 the player decides to enter and play game(s) of skill or chance at the second level 20 of game play, then the method 88 moves to decision block 100 where the method 88 determines whether the player has satisfied the contingency(ies) of the first level 10 of game play in order to play the second level 20 of game play. If the player has not satisfied the contingency(ies), then the method 88 passes to block 96 where the player plays the game(s) of skill or chance at the first level 10 of game play only and wins accordingly. The player then decides whether he/she will play a new game 5. If the player decides to play a new game 5 at block 98, then the method 88 loops back to the start block 90 where the player starts a new game 5. If the player decides not to play a new game 5, then the method 88 passes to block 106 where the player ends play of the game 5.

If the player has satisfied the contingency(ies) of the first level 10 of game play in order to play the second level 20 of game play, then the method 88 passes to block 102 where the player enters the second level 20 of game play. The player plays the games of skill or chance at the first level 10 and the second level 20 of game play and wins accordingly at block 104. The method 88 then moves to block 98 where the player decides to play a new game 5. If the player decides to play a new game 5 at block 98, then the method 88 loops back to the start block 90 where the player starts a new game 5. If the player decides not to play a new game 5, then the method 88 passes to block 106 where the player ends play of game 5.

II. Games of Skill or Chance for Levels of Game Play and Details for TRILOGY™ Lottery Ticket Game.

FIGS. 5 and 6 refer to games of skill or chance that are defined for the first level 10 and the second level 20 of game play. These games of skill or chance are not in any way limited to any particular games of skill or chance, and any suitable games of skill or chance may be used in conjunction with the present invention, including but not limited to lottery ticket games such as instant lottery games, pull-tab ticket games, scratcher ticket games, card games such as high card, blackjack or twenty-one, poker, dice games, roulette games, etc.

The TRILOGYυ lottery ticket game, which is generally a game of chance that is used in conjunction with the present invention for the preferred embodiment, is now described in detail. FIGS. 7 to 13 show lottery tickets and an electronic machine for the TRILOGY™ lottery ticket game. These figures are used to explain the TRILOGY™ lottery ticket game. The TRILOGY™ lottery ticket game is a combined instant win lottery game with a jackpot win lottery game. The game involves a ticket with a combination instant lottery game and progressive lottery game wherein the progressive lottery game provides a continuous progressive jackpot that can be won at the time a ticket is purchased. Therefore, the game combines instant win games with a time-of purchase win progressive jackpot game.

Figure 7:
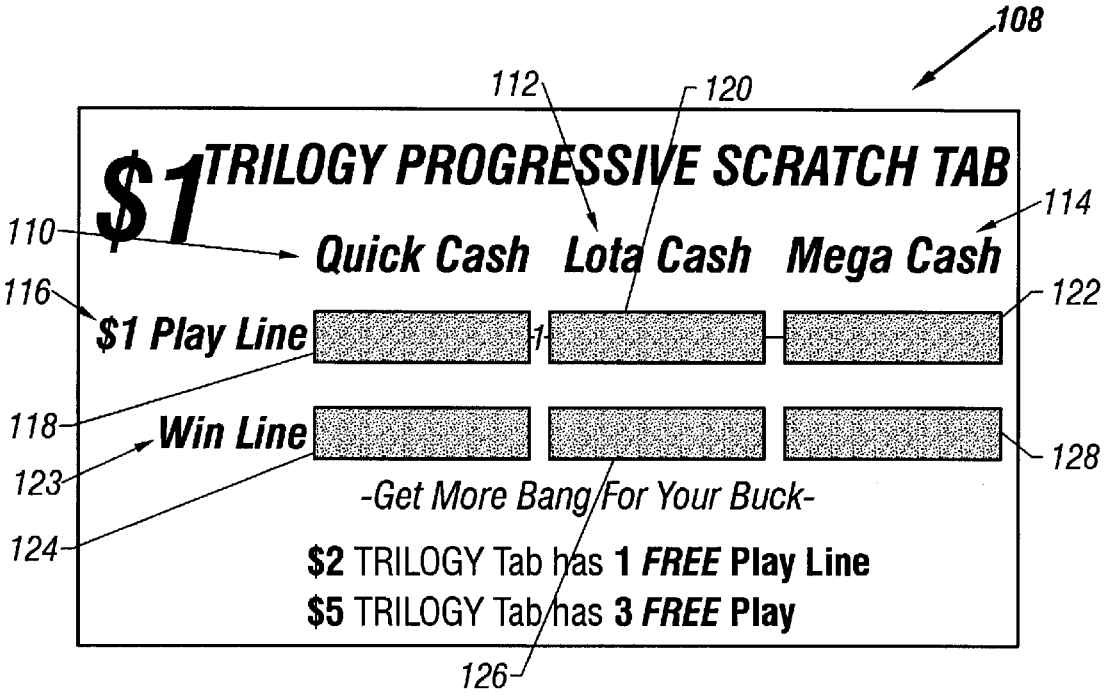
FIG. 7 is a front face of a one-dollar lottery ticket for the present TRILOGY™ lottery ticket game wherein the playing indices are covered by removable cover material.

FIG. 7 shows a lottery ticket 108 for the TRILOGY™ lottery ticket game. The ticket 108 has a play line 116 and a win line 123. Three columns are shown along the play line 116. The first column shows a "Quick Cash" play 110. The second column shows a "Lota Cash" play 112, and the third column shows a "Mega Cash" play 114. The "Quick Cash" play 110, "Lota Cash" play 112, and the "Mega Cash" play 114 are three game plays for each game line. Each game line 116 is defined as a $1.00 play line, and each game line 116 has a play area 118 for the "Quick Cash" play 110, a play area 120 for the "Lota Cash" play 112, and a play area 122 for the "Mega Cash" play 114. Each play area represents an opportunity for the player to win for each respective game play 110, 112, or 114 along the play line 116. The win line 123 comprises a "Quick Cash" win indicator 124, a "Lota Cash" win indicator 126, and a "Mega Cash" win indicator 128, and each win indicator 124, 126, or 128 reflects the total winnings for each respective game play: "Quick Cash" play 124, "Lota Cash" play 126, and "Mega Cash" play 128. As shown in FIG. 7, the play areas 118, 120, and 122 and win indicators 124, 126, and 128 when printed or displayed are initially concealed or covered. The material used to conceal or cover these areas may be a removable coating, scratch-off material, a pull tab, a black security latex covering, or any other suitable removable cover material.

Figure 8:
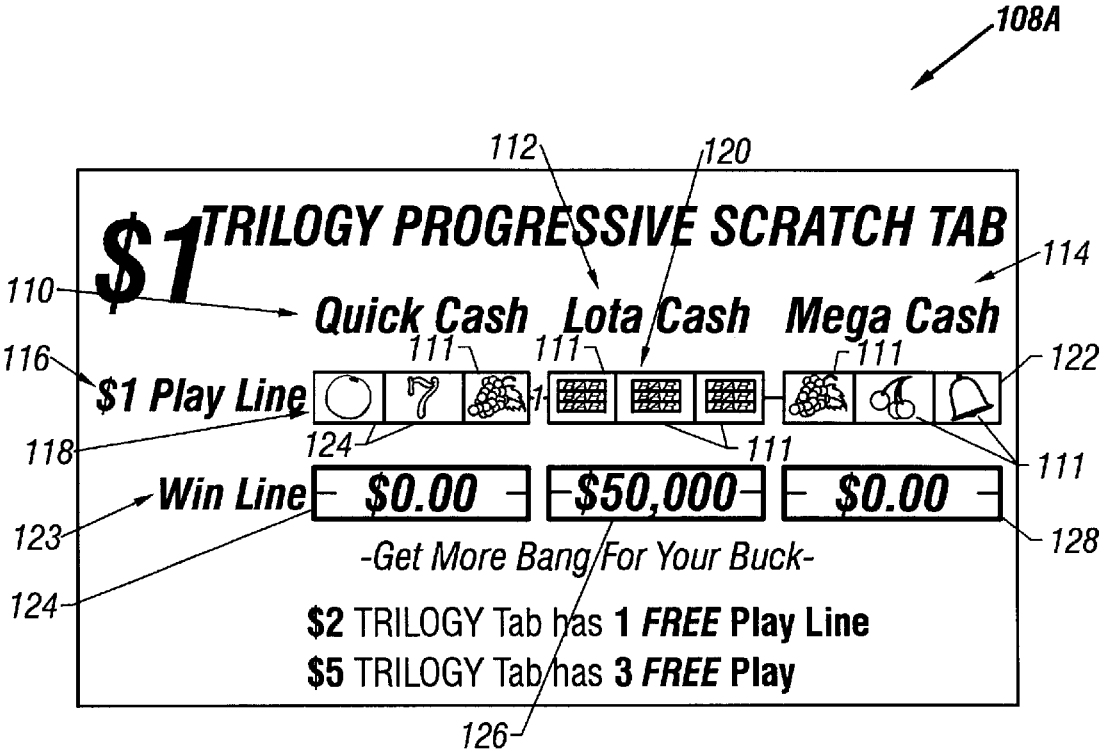
FIG. 8 is a front face of a one-dollar lottery ticket for the present TRILOGY™ lottery ticket game wherein the cover material has been removed and the playing indices are shown.

FIG. 8 shows a front side of an example of a first embodiment TRILOGY™ lottery ticket 108A. The first embodiment ticket 108A is shown as a One Dollar ($1.00) TRILOGY™ progressive scratch tab ticket. The ticket 108A shows that the covering or concealing material has been removed. The play line 116 shows the play indices 111 in the "Quick Cash" play area 118 as "Lemon-Seven-Grapes", in the "Lota Cash" play area 120 as "Bar-Bar-Bar", and in the "Mega Cash" play area 122 as "Grapes-Cherries-Bell". The win line 123 when printed or displayed shows the total winnings for each play. The win line 123 in FIG. 8 shows the winning indicator 124 for the "Quick Cash" play 110 as $0.00, the winning indicator 126 for the "Lota Cash" play 112 as $50,000.00, and the winning indicator 128 for the "Mega Cash" play as $0.00.

Figure 9:
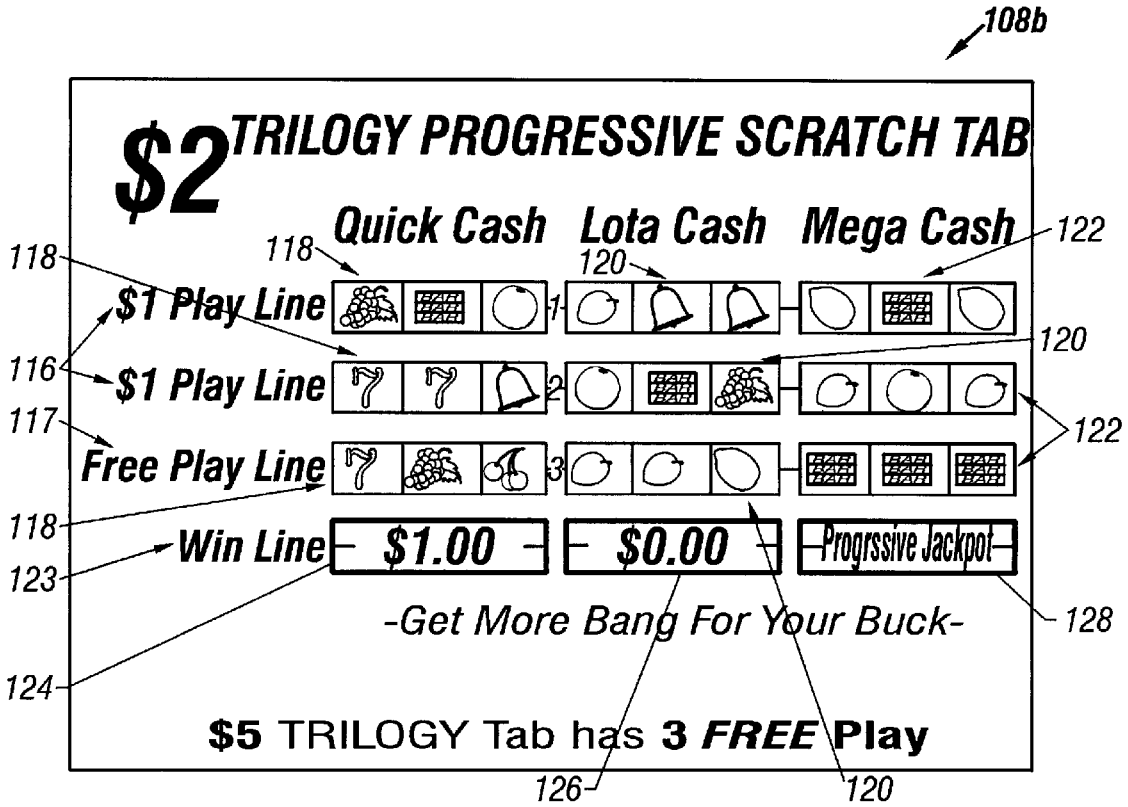
FIG. 9 is a front face of a two-dollar lottery ticket for the present TRILOGY™ lottery ticket game wherein the cover material has been removed and the playing indices are shown.

FIG. 9 shows a front side of an example of a second embodiment TRILOGY™ lottery ticket 108B. The second embodiment ticket 108B is shown as a Two Dollar ($2.00) TRILOGYT™ progressive scratch tab ticket. The second embodiment ticket 108B is similar to the first embodiment ticket 108A. The difference between these tickets being that an additional $1.00 play line 116 and a free play line 117 are provided on the ticket 108B. The $2.00 ticket 108B has the two play lines 116 that the player pays for and has a free play line 117 to provide additional incentive to the player to purchase a second embodiment ticket 108B over a first embodiment ticket 108A. Therefore, the player is provided with a better deal with the second embodiment ticket 108B over the first embodiment ticket 108A since the player pays for two play lines and gets the third play line for free.

FIG. 10 shows a front side of an example of a third embodiment TRILOGY™ lottery ticket 108C. The third embodiment ticket 108C is shown as a Five Dollar ($5.00) TRILOGY™ progressive scratch tab ticket. The third embodiment ticket 108C is similar to the first and second embodiment tickets 108A and 108B. The difference between these tickets being that five $1.00 play line 116 and three free play lines 117 are provided for the third embodiment ticket 108C. The $5.00 ticket 108C has the five play lines 116 that the player pays for and has three free play lines 117 to provide even further additional incentive to the player to purchase a third embodiment ticket 108C over a first or a second embodiment ticket 108A or 108B. Therefore, the player is provided with a better deal with the third embodiment ticket 108C over the first and second embodiment tickets 108A and 108B since the player pays for five play lines and gets the sixth, seventh, and eighth play line for free.

Figure 11:
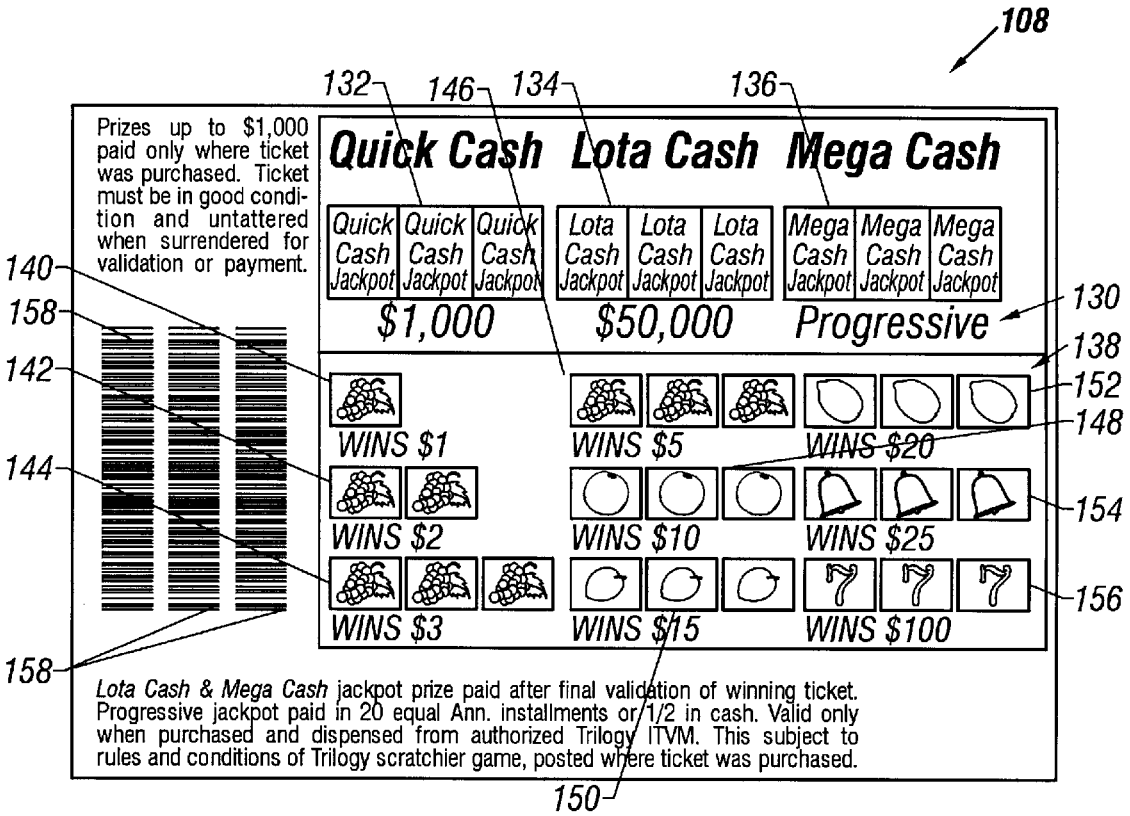
FIG. 11 is an embodiment of a back face of a lottery ticket for the present TRILOGY™ lottery ticket game.
Figure 12:
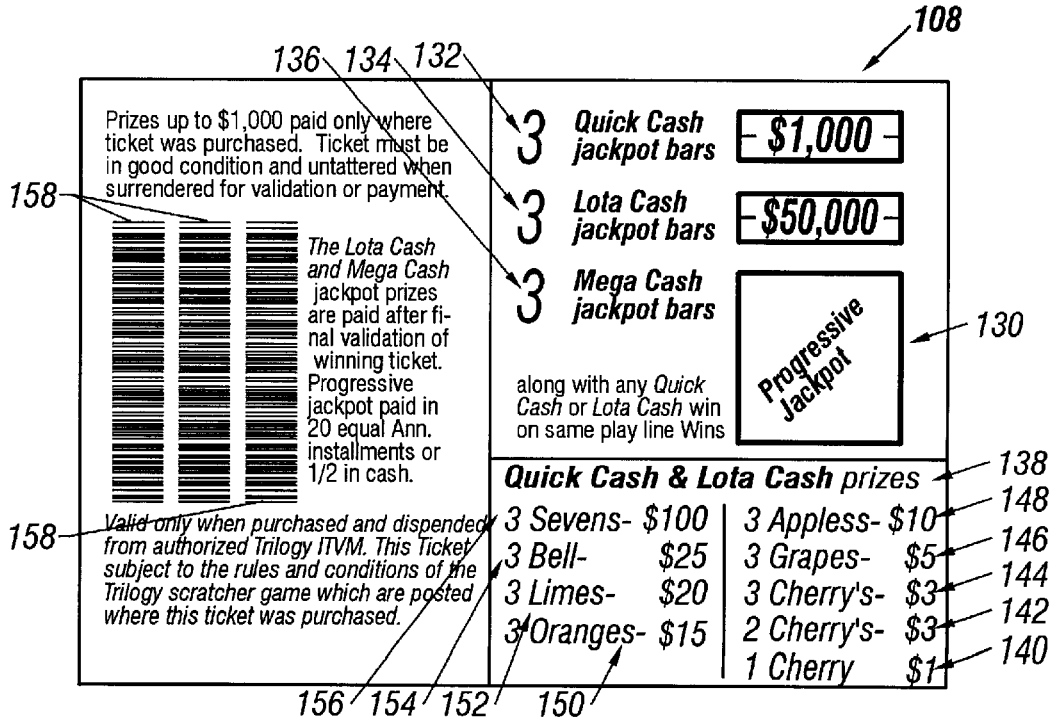
FIG. 12 is another embodiment of a back face of a lottery ticket for the present TRILOGYυ lottery ticket game.

FIGS. 11 and 12 show on the back side of a ticket 108 examples of how a player wins the "Quick Cash" play 110, the "Lota Cash" play 112, and the "Mega Cash" play 114. FIGS. 11 and 12 are identical as to context and differ only as to presentation. The figures show an area 138 where definitions as to how a player wins the instant amounts for the "Quick Cash" play 110 and the "Lota Cash" play 112 are displayed. For these two plays 110 and 112 in the examples of FIGS. 11 and 12, instant wins for a player are respectively defined as the following combinations within the play area 118 or 120 as follows: 1) a single cherry 140 wins $1.00; 2) two cherries 142 wins $2.00; 3) three cherries 144 wins $3.00; 4) three grapes 146 wins $5.00; 5) three strawberries 148 wins $10.00; 6) three oranges 150 wins $15.00; 7) three limes 152 wins $20.00; 8) three bells 154 wins $25.00; 9) three sevens 156 wins $100.00.

The figures show an area 130 where definitions as to how a player wins the jackpot amounts for the "Quick Cash" play 110, the "Lota Cash" play 112, and the "Mega Cash" play 114 are displayed. The jackpot wins for the "Quick Cash" play 110 and the "Lota Cash" play 112 are respectively defined as the combination of three bars 132 and 134 (i.e. bar-bar-bar) within the play areas 118 and 120. The jackpot for the "Quick Cash" play 110 has been defined as a fixed amount of $1,000.00, and the jackpot for the "Lota Cash" play 112 has been defined as a fixed amount of $50,000.00. In order for a player to win the "Mega Cash" play 114, the player must have the combination of three bars 136 in the play area 122 and any win (i.e. whether instant or jackpot win) from the "Quick Cash" play 110 and/or the "Lota Cash" play 112 in the same $1.00 play line 116 or in the same free play line 117. The jackpot for the "Mega Cash" play 114 is defined as a progressive jackpot amount that is proportional to the sales of the tickets 108 (i.e. 108A, 108B, and 108C). (Typically, the progressive jackpot is derived and generated from a percentage of the sales of these tickets). The progressive jackpot starts at an initial amount and continues to increase as ticket sales increase and as no winning ticket 108 has yet been sold. When a winning ticket 108 is sold, the time, date, and amount of the progressive jackpot is recorded, and the progressive jackpot amount is then reset to an initial amount. The present game, therefore, provide the capabilities of monitoring and tracking the winning ticket(s) and accordingly resetting the jackpot.

FIGS. 11 and 12 also show bar codes 158 on the back side of the tickets 108. The encrypted bar code(s) 158 is printed on each ticket 108. The bar code 158 contains all the game information printed on the ticket 108, which includes the deck and deal number. The bar codes 158 are read by a bar code scanner prior to being dispensed or sold to a player. When the bar code 158 on the ticket 108 is scanned, the electronic scanner communicates to a retailer computer that, in turn, communicates with a computer system 176. One of the bar codes 158 at least contains information reflective of the play indices on the front side of the ticket 108. The bar code(s) 158 may be read to display the indices and/or corresponding win amounts for the respective game plays 110, 112, and/or 114 on an electronic display, monitor, or other such device. The bar code(s) 158 is read by a bar code scanner and tracking system to determine whether the ticket 108 contains an instant win and/or a jackpot win. If a win exists on a read ticket 108, then the system makes note of the dispensing and/or selling of the sold winning ticket 108. The system also records the time, date, and/or location of sale of that winning ticket 108 and records the corresponding win amount(s).

If the winning amount is a progressive jackpot, then the time, date, location, and jackpot win amount is recorded by the system. The system flags and notifies others that a winning ticket 108 has been sold, and the jackpot win amount is recorded at the time of sale of that winning ticket 108. This jackpot win amount may be displayed. After a winning progressive jackpot ticket 108 has been sold, then the progressive jackpot amount is reset to an initial amount. On the other hand, if a winning progressive jackpot ticket 108 has not yet been sold, then the progressive jackpot amount continues to increase as the number of tickets 108 sold continue to increase. The bar code 158 may also be read to validate and verify a ticket 108 as a ticket having certain play indices 111 and as a winning ticket 108.

Therefore, the TRILOGY™ lottery ticket game provides smaller instant win opportunities and win amounts and at least one progressive jackpot win opportunity and win amount. The possibility of winning smaller amounts as well as a larger progressive jackpot amount provide players with additional incentives to play the TRILOGY™ lottery ticket game (i.e. this concept was shown in FIG. 1 and described in detail earlier). The play of the game and sales of tickets 108, of course, continue to drive the progressive jackpot amount for the "Mega Cash" play 114. One of the features of the TRILOGY™ lottery ticket game is that instant win play and jackpot play continues even after any winning ticket 108 (i.e. whether instant win or jackpot win) is sold and/or dispensed. A player may validate and/or defer finding out whether he/she has won an instant win and/or jackpot at a later time since the system tracks whether a winning ticket 108 has been sold and dispensed and records the corresponding win amount(s), time, date, location of sale. The system resets the progressive jackpot to an initial amount when a winning progressive jackpot ticket 108 has been sold or dispensed.

The TRILOGYT™ lottery ticket game is implemented by printing and defining a number of tickets 108 for each deck and defining two or more decks for each deal. For example, one thousand (1,000) TRILOGY™ lottery tickets 108 may be defined as a deck, and four (4) decks are defined as a deal (i.e. four thousand (4,000) tickets 108 for each deal). The rules of printing the tickets 108 may be defined such that a three-bar play winning indices 111 for the "Mega Cash" play 114 is printed on one ticket 108 within each deck. However, the three-bar play indices 111 may or may not be on the same play line 116 or 117 of a win combination from the "Quick Cash" play 110 and/or the "Lota Cash" play 112.

The win combination from these other plays 110 and/or 112 exist or do not exist on a ticket based on a random selection by the system that generates and prints the tickets 108. Therefore, since the generation of the winning "Mega Cash" ticket 108 is entirely random, it is not known when the actual winning ticket 108 for the progressive jackpot will be sold. As a deal(s) of tickets 108 continue(s) to be sold and the winning ticket 108 for the "Mega Cash" play 114 has not yet been sold, then the jackpot for the "Mega Cash" play 114 rolls over to the next deal(s) that is/are added. If the "Mega Cash" jackpot is a progressive jackpot, then the jackpot continues to increase as the jackpot is rolled over to a subsequent deal. When the winning ticket 108 is finally sold, then the time, date, location, and amount of jackpot when the winning ticket 108 was sold are recorded. The system indicates that a winning ticket 108 for the "Mega Cash" play 114 has been sold, and the jackpot is reset to an initial amount so that play of the TRILOGY™ lottery tickets 108 and the sale of TRILOGY™ lottery tickets 108 are not interrupted and continues. The implementation of the TRILOGY™ lottery ticket game is unique in that the game provides a way of continuing play and rolling over and building of a larger jackpot(s) as more decks and deals are added for play of the game. The tickets 108 are simultaneously sold by authorized TRILOGY™ ticket retailers from each deck and deal. The players of the TRILOGY™ lottery ticket game simultaneously play the game against each other without any advantage over other plays in order to win.

Figure 13:
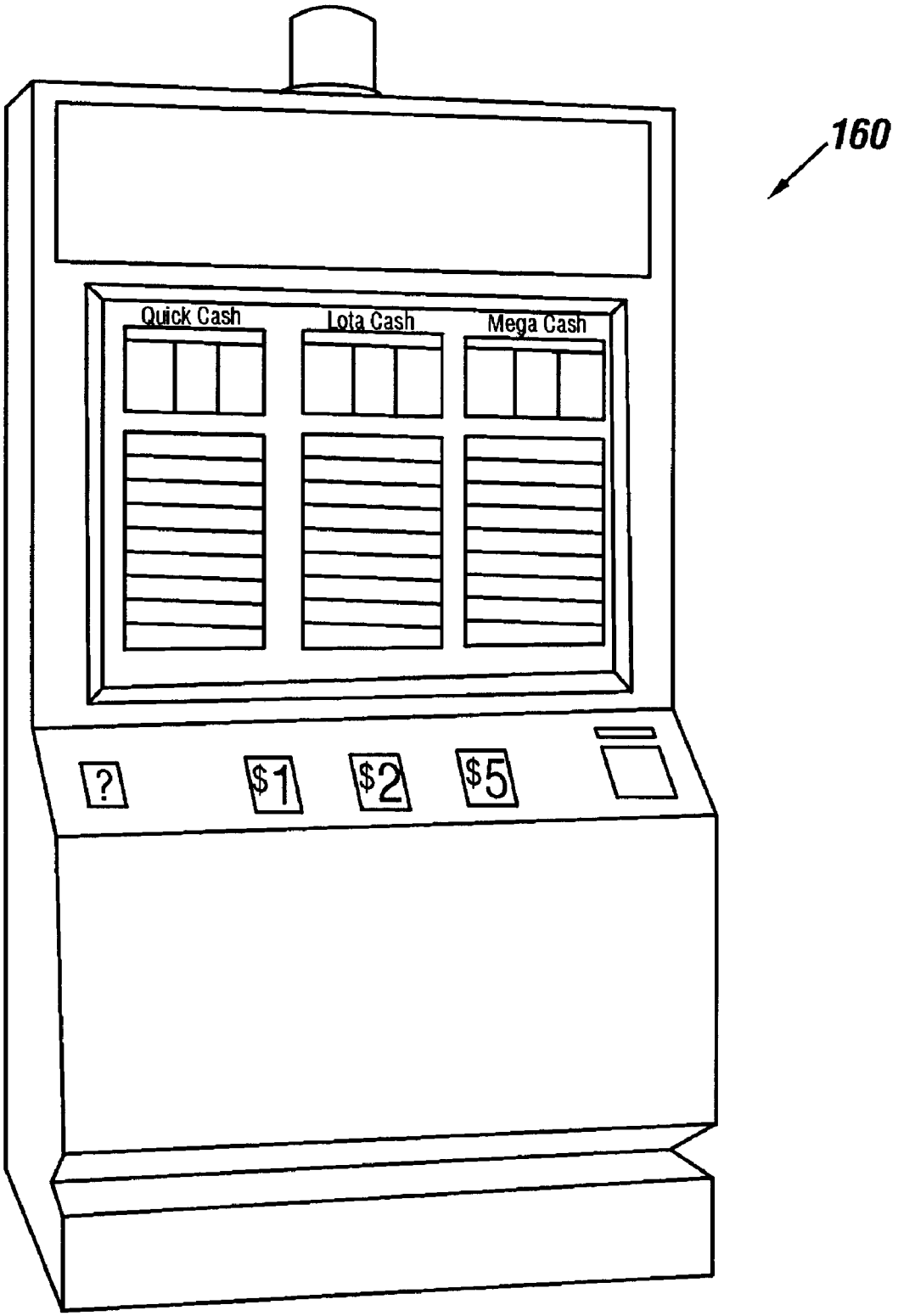
FIG. 13 is a perspective view of an electronic embodiment of the present TRILOGY™ lottery ticket game.

FIG. 13 shows that an electronic machine 160 may be used in conjunction with the TRILOGY™ lottery ticket game. The machine 160 may be a dispensing apparatus for the tickets 108. The machine 160 receives money/chips from the player. The machine 160 dispenses the tickets 108, and the machine 160 has a bar code scanner that reads the bar codes 158 of the tickets 108 as they are being dispensed. The machine 160 is able to display the playing indices 111 and the winning indicators 124, 126, and 128 on the front side of the ticket 108 being read. The machine 160 may also display the jackpot amounts for each of the respective plays (i.e. "Quick Cash" play 110, "Lota Cash" play 112, and "Mega Cash" play 114). The machine 160 would accordingly display a $1.00 ticket, a $2.00 ticket, or a $5.00 ticket depending on which ticket the player purchased. The machine 160 may also be a fully electronic version wherein the TRILOGY™ lottery ticket game is played electronically and no tickets 108 are dispensed. In the fully electronic version, the ticket 108 and the corresponding win indices would be displayed by the machine 160 as the player inserts money/chips therein. The machine 160 may dispense the corresponding win amounts if it is determined that the player has obtained a displayed winning ticket 108. The TRILOGY™ lottery ticket game is not limited to the implementation that has just been described, and any suitable implementation may be used to carry out the TRILOGY™ lottery ticket game.

III. TRILOGY™ Lottery Ticket Game with Multiple Levels of Game Play

A. First Embodiment of TRILOGY™ Multiple Level Game

One embodiment of the TRILOGY™ lottery ticket game having multiple levels of game play is disclosed in FIGS. 14 to 17A. The game 5A and respective playing field 5B comprises a first level 10 of game play and a second level 20 of game play (i.e. as outlined in FIG. 1A). The first level 10 of game play involves the normal play of the TRILOGY™ lottery ticket game as was described earlier in Section II of this specification. The circular or wager areas 6, 7, and 8 at the first level 10 of game play are provided for the identified, numbered player 9 to place respective chip amounts upon so that the player may play/purchase the respective dollar amount TRILOGY™ lottery ticket game (i.e. $1.00 ticket, $2.00 ticket, or $5.00 ticket as described in detail earlier above). The rule of this game 5A is that in order for the identified, numbered player 9 to play the table jackpot for the respective dollar amount game (i.e. $1.00, $2.00, or $5.00 game) in the second level 20 of game play, the player must have played/purchased the respective dollar amount TRILOGY™ lottery ticket 108 (i.e. $1.00 ticket, $2.00 ticket, or $5.00 ticket) in the first level 10 of game play. Therefore, this rule is defined as the contingency that the player 9 must satisfy in the first level 10 in order to enter and play the second level 20 of game play.

The identified, numbered player 9 places chips for his/her wager on the circular or wager areas 16, 17, and/or 18 for the second level 20 of play only if the player 9 has played/purchased the respective ticket amount by placing chips in the respective circular or wager areas 6, 7, and/or 8 at the first level 10 of play. In other words, a player may only place a wager on the circular or wager area 16 for the $1.00 game jackpot for the second level 20 of play only if the identified, numbered player 9 played/purchased the $1.00 TRILOGY™ lottery ticket 108 by placing a chip on circular or wager area 6 at the first level 10 of play. Also, an identified, numbered player 9 may only place a wager on the circular or wager area 17 for the $2.00 game jackpot for the second level 20 of play only if the player 9 played/purchased the $2.00 TRILOGY™ lottery ticket 108 by placing a chip on circular or wager area 7 at the first level 10 of play. Furthermore, a player 9 may only place a wager on the circular or wager area 18 for the $5.00 game jackpot for second level 20 of play only if the player played/purchased the $5.00 TRILOGY™ lottery ticket 108 by placing a chip on circular or wager area 8 at the first level 10 of play.

Each player 9 places chips on the respective circular or wager areas 6, 7, and/or 8 for the purchase of tickets 108 for the first level 10 of play and places chips on the respective circular or wager areas 16, 17, and/or 18 for the play of the table jackpot(s) for the second level 20 of play. After players 9 place the chips on the desired circular areas by the players 9, the dealer activates a wager activation button or switch 185 (i.e. see FIG. 16) so that the computer system 176 locks (i.e. see FIG. 15A) in and records all wages/plays made by the players 9 at both the first and second levels 10 and 20 of play. The system 176 also checks to see whether each player satisfied the rule where the player must satisfy the contingency of the first level 10 of play in order to enter the second level 20 of play. In other words, the system 176 checks to see whether the player 9 made the respective play/purchase in the first level 10 of play in order to make the respective wager in the second level 20 of play. If a player 9 has not satisfied the contingency in the first level 10 of play, the system 176 flags the dealer to invalidate the wager made in the second level 20 of play and notifies the dealer to return the wager made by that player 9 in the second level 20 of play.

Figure 15:
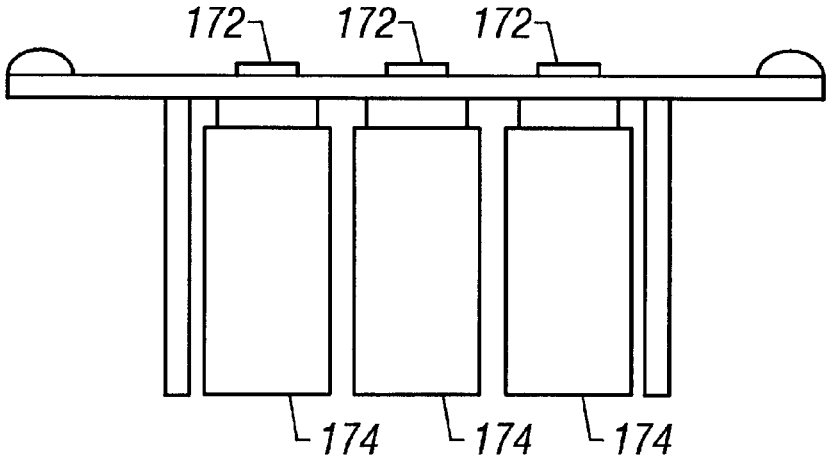
FIG. 15 is a back side view of a game table of the present invention multiple incentive/multiple level game showing the ticket dispenser/vault and computer units.
Figure 15A:
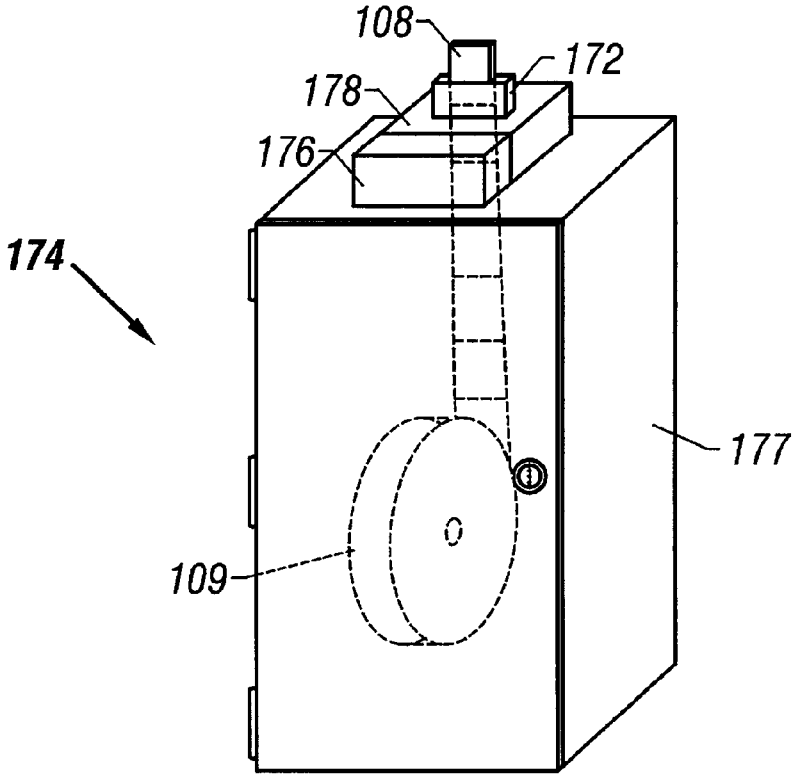
FIG. 15A is a perspective view of a ticket dispenser/vault computer unit used with the game table of the present invention multiple incentive/multiple level game.
Figure 16:
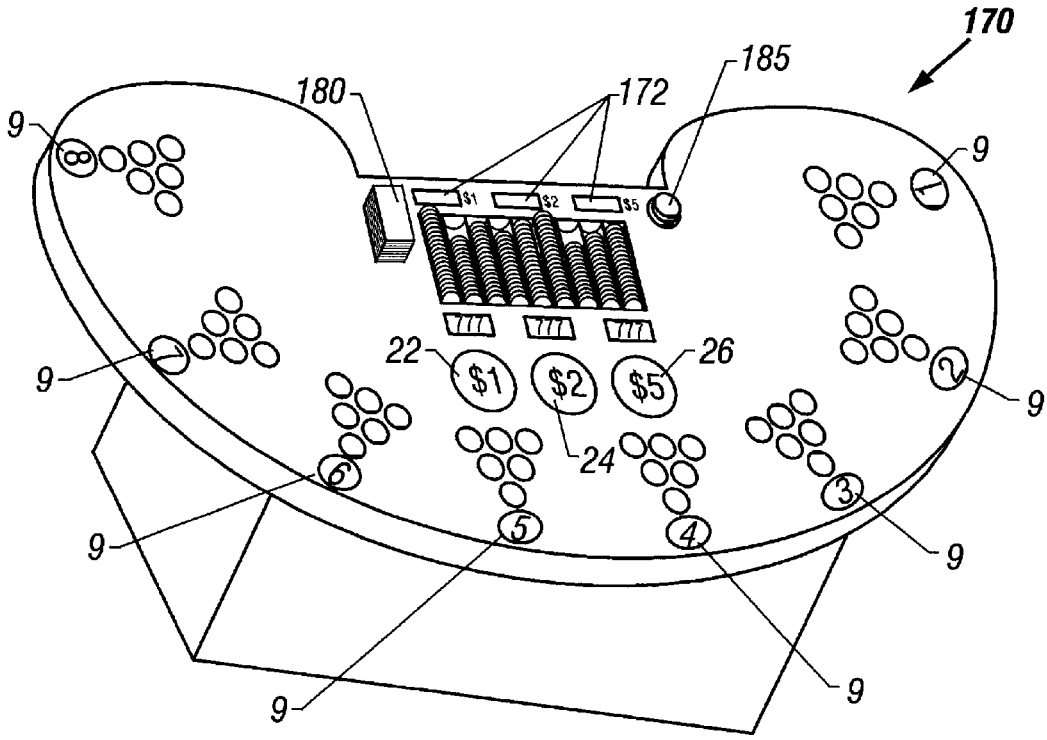
FIG. 16 is a top perspective view of a game table embodiment for the present invention multiple incentive/multiple level game.
Figure 16A:
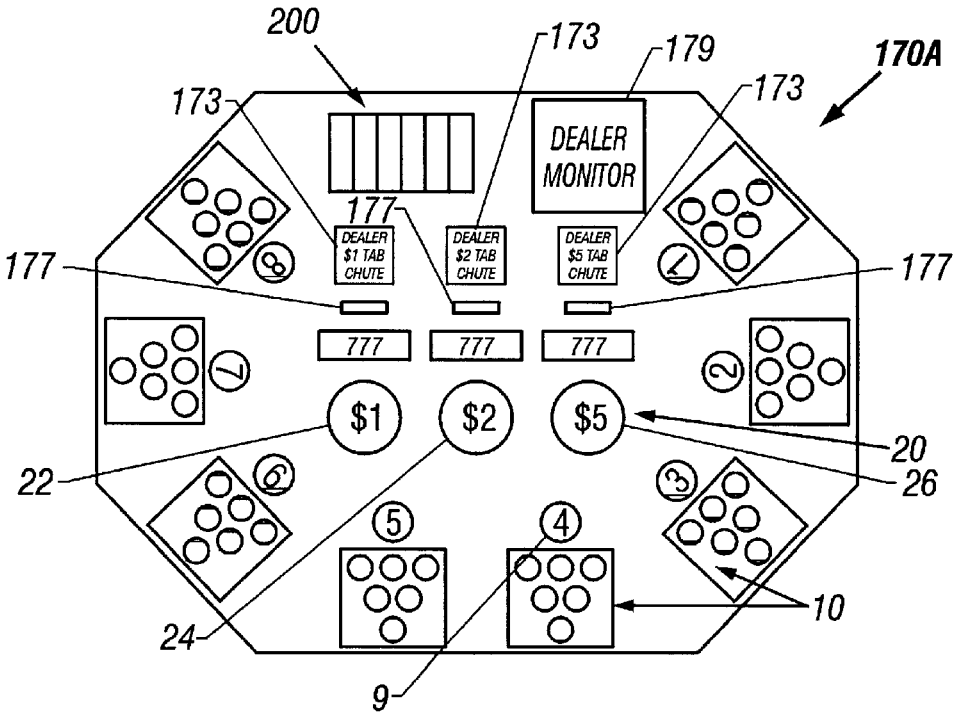
FIG. 16A is a top view of another game table embodiment for the present invention multiple incentive/multiple level game.

The dealer collects the chips placed on the circular or wager areas 6, 7, and 8, and, in exchange for the chips, the dealer deals/provides the players 9 with the corresponding $1.00, $2.00, and $5.00 TRILOGY™ lottery ticket 108. As shown in FIGS. 16 and 16A, the respective tickets 108 are dispensed from a respective ticket dispenser 172 or a respective ticket chute 173. The hopper for each ticket dispenser 172 may be located on a ticket roll 109 or on a perforated or stack of tickets 108 in a computer/ticket vault 174 as shown in FIGS. 15 and 15A. The chutes 173 are located on the table as shown in FIG. 16A. The computer/ticket vault 174 contains at least the computer 176 for monitoring game activity and for communicating with and networking to a wide area or house computer, a ticket vault 177, a ticket scanner 178, and a ticket dispenser 172. The dealer collects the chips placed and wagered on the circular or wager areas 16, 17, and 18, and the dealer respectively places them in the larger table jackpot circular areas 22, 24, and 26. The computer system 176 collects all ticket sales and accounting information and sends the progressive jackpot information to retailer computers at retailers for display of progressive jackpots on video monitors at the retailer locations. Only when a bar code 158 of a ticket 108 is scanned by a retailer computer, then that ticket 108 is activated as a live ticket sale recorded by the computer system 176.

A play tracking component(s) is/are coupled to a lottery play area for first level 10 and to a jackpot game play area for second level 20 for tracking play made by each of the players 9. For example, FIG. 14A shows a light feature 240 that exists for each of the circular or wager areas 6, 7, 8, 16, 17, and 18 for the present invention. This light feature 240 has a sensor 242 that senses whether a chip was placed thereon when the dealer activated the button or switch 185. If the sensor 242 sensed a chip at the corresponding circular or wager area when the button or switch 185 was activated, then a light or light bulb 244 is activated and is shone through to show that a chip was placed thereon. The light feature 240 also has a flashing light component (i.e. not shown) coupled thereto which is activated to flash the light 244 to indicate the winning player 9 for a particular game at a particular came level 10 or 20. The players then play their respective TRILOGY™ lottery tickets 108. The light 244 in the second level 20 of play (i.e. circular/wager area 16, 17, or 18) activate only if the respective light 244 in the first level 10 of play (i.e the respective circular/wager area 6, 7, or 8) was activated. This method of activating the light feature 244 provides the check by the computer system as to whether the player 9 has made the appropriate play/purchase in the first level 10 of play in order to enter and wager in the second level 20 of play.

FIGS. 14B and 14C show that each light feature 240 near the circular or areas 6, 7, and 8 may also have a color light near it or within it. A color coding scheme 247 is shown in FIG. 14D. Each color of the color coding scheme 247 represents an instant win amount. If a player purchases/plays the ticket 108 and the player wins a certain instant win amount on the ticket 108, then the corresponding color light from the color light setup 245A or 245B of the color coding scheme 247 is lit. The color coding scheme 247 in FIG. 14D is an example which shows the colors defined or represented as follows: 1) a yellow color light is a $1.00 win; 2) a blue color light is a $2.00 win; 3) a green color light is a $3.00 win; 4) a red color light is a $5.00 win; 5) a brown color light is a $10.00 win; 6) a gray color light is a $15.00 win; 7) a pink color light is a $20.00 win; 8) a purple color light is a $25.00 win; 9) an orange color light is a $100.00 win. FIG. 14B shows that each color light 245A represents one of the nine. win possibilities, and the color lights 245A entirely surround each light feature 240. Alternatively, FIG. 14C shows that a color light bulb(s) 245B within the light feature 240. The color light bulb(s) 245B is/are able to light up one of the color lights that represent the nine win possibilities when the corresponding win possibility occurs. When a player wins one of the instant win amounts on a particular dollar amount ticket 108, the corresponding circular or wager area 6, 7, or 8 is flashed and the colored light 245A or 245B corresponding to the respective win amount is lit at the player's area. For example, if a player won $25.00 on a $2.00 TRILOGY™ lottery ticket 108, then the light at the circular or wager area 7 is flashed and the purple light 245A or 245B of the light feature 240 at circular or wager area 7 is lit at that player's play area or station. As another example, if a player won $100.00 on a $5.00 TRILOGY™ lottery ticket 108, then the light at the circular or wager area 8 is flashed and the orange light 245A or 245B of the light feature 240 at circular or wager area 8 is lit at that player's play area or station.

Figure 14:
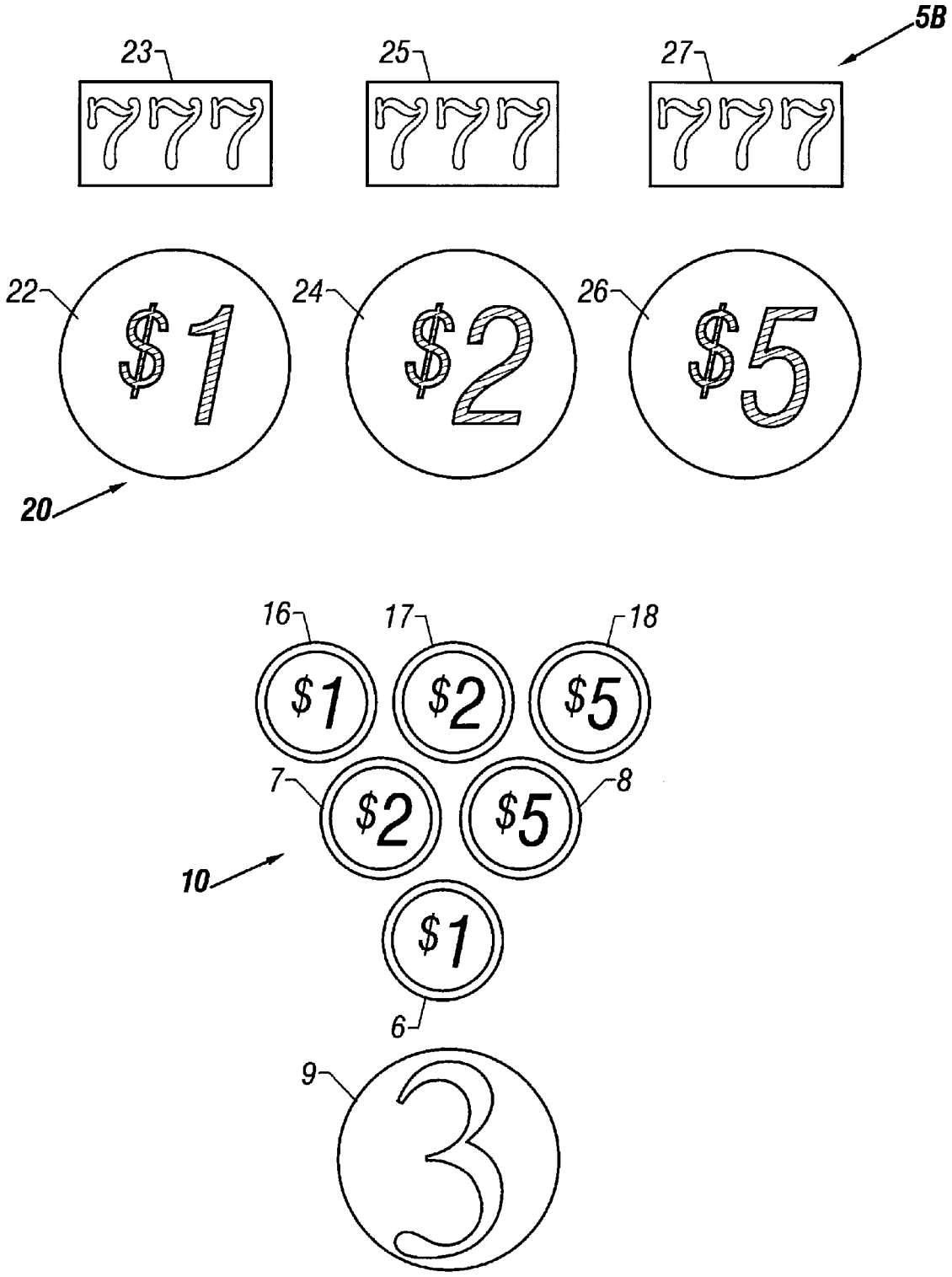
FIG. 14 is a top view of a player area on a game table for the present invention multiple incentive/multiple level game.

When the dealer collects the chips placed on the circular or wager areas 6, 7, and 8 and exchanges them for the tickets 108, the dealer also collects the chips placed or wagered on the circular or wager areas 16, 17, and 18 and places them onto the respective table jackpot area 22, 24, and 26 as shown in FIGS. 14, 16, and 16A. In other words, the chips placed on the circular or wager area 16 are gathered and placed into the table jackpot circular area 22, and the chips placed on the circular or wager area 17 are gathered and placed into the table jackpot circular area 24. Furthermore, the chips placed on the circular or wager area 18 are gathered and placed into the table jackpot circular area 26.

Figure 17:
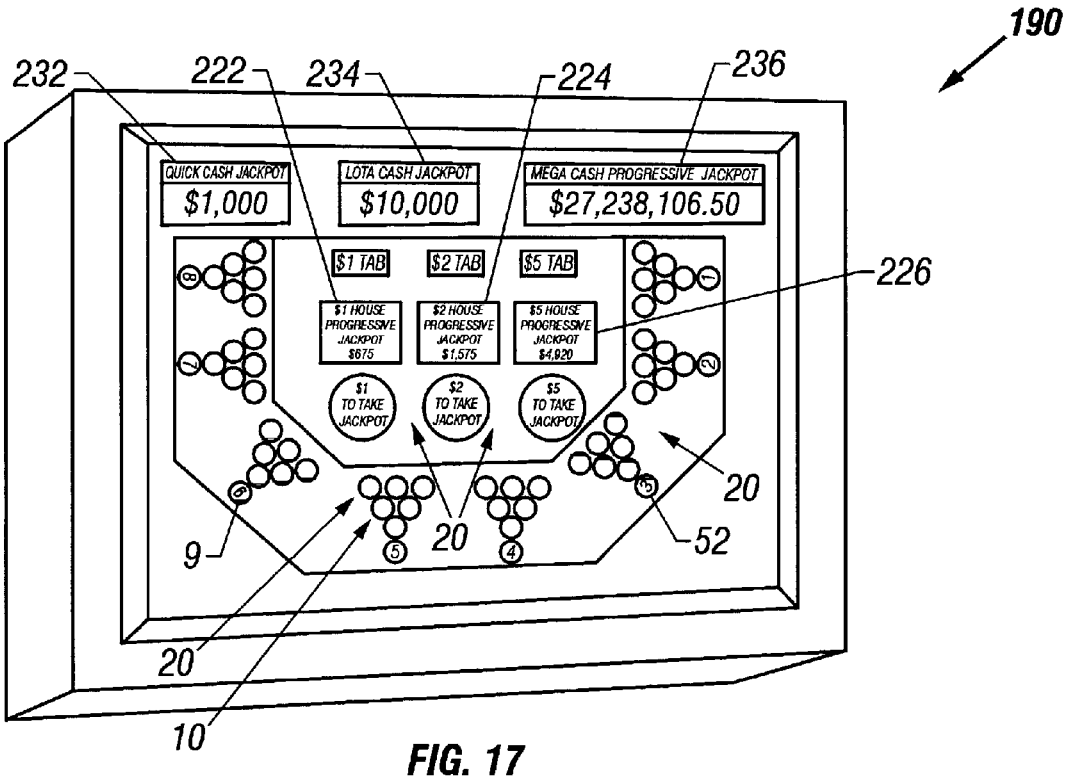
FIG. 17 is a side perspective view of a player/viewer monitor embodiment for the present invention multiple incentive/multiple level game that reflects play on the game table of FIG. 16.
Figure 17A:
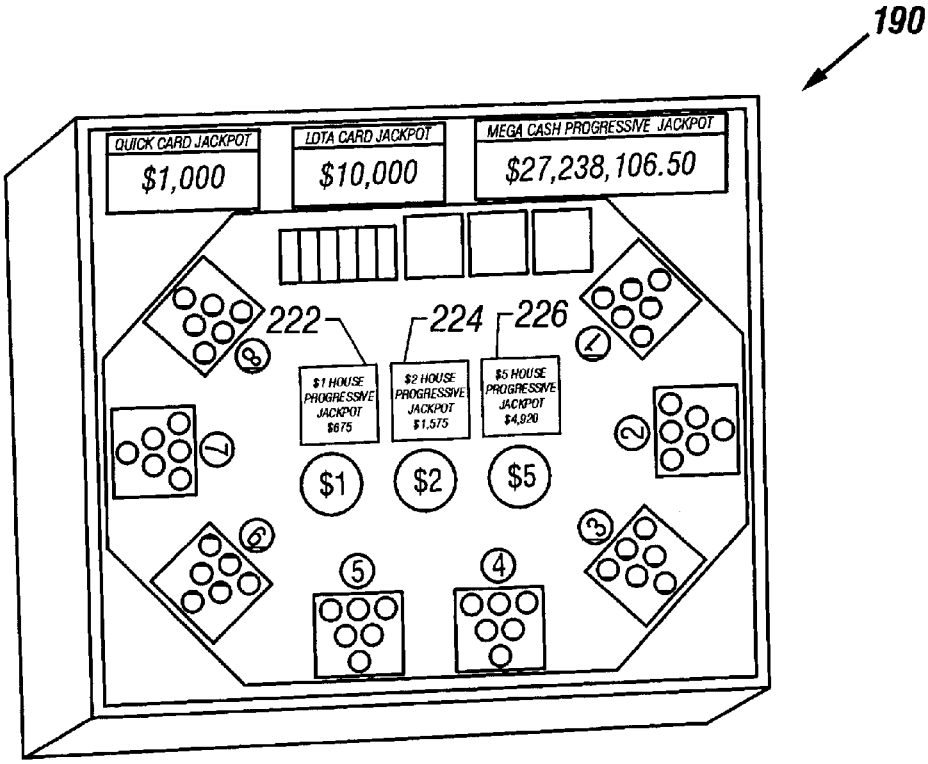
FIG. 17A is a side perspective view of another player/viewer monitor embodiment for the present invention multiple incentive/multiple level game that reflects play on the game table of FIG. 16A.

A method is used for determining who the winner is for the table jackpot in the second level 20 of play. One embodiment method for determining who the table jackpot winner is for the second level 20 of play is disclosed as follows: For each dollar amount TRILOGYυ lottery ticket play, the highest TRILOGY™ ticket 108 determines who wins the table jackpot in the second level 20 of play from the respective jackpot circular area 22, 24, or 26. For example, the highest winning TRILOGY™ lottery ticket 108 is made to determine the winner of the table jackpot in the second level 20 of play from the respective jackpot circular area 22, 24, or 26. If the winning TRILOGYυ lottery ticket 108 of two players are tied, then the table jackpot in circular area 22, 24, or 26 is split among the winners or the pot rides until the pot is won by a player. The amounts of chips remain in the table jackpot and a percentage of the table jackpot may or may not be provided to the progressive jackpot 222, 224, or 226 as shown in FIGS. 17 and 17A. The game may be defined such that if no players have a winning ticket, then the table jackpot in circular area 22, 24, or 26 pushes. Alternatively, non-winning combinations for the TRILOGY™ lottery ticket game may be structured or ordered in a hierarchy such that a winner for at least the table jackpot in circular area 22, 24, or 26 is determined. Other methods of determining how a player wins the table jackpot from the circular areas 22, 24, or 26 exists, and other such methods will be discussed later in this specification. The present invention is not limited to the methods of determining a table jackpot winner disclosed in this specification, and other suitable methods may be used with the present invention in determining who the winner is for the table jackpot in the second level 20 of play. When a player wins a table jackpot, the player's respective light feature 240 at circular or wager area 16, 17, or 18 depending on which jackpot was won starts flashing to indicate to the dealer that the player is the winner of that respective jackpot.

For example, if a player won the table jackpot for the $1.00 TRILOGY™ lottery ticket play, then the light feature 240 at circular area 16 for that player would flash. Each ticket 108 submitted for redeeming the table jackpot win may be rescan by the dealer or game controller (i.e. computer dealer, etc.) for verification that the ticket 108 was in fact sold and activated as a live ticket 108 at the dealer's or game controller's table, that the ticket 108 is in fact a winning ticket, and that the ticket 108 has not been altered or modified in any manner. The winning ticket 108 may then dropped into a secured tab win box in the computer/ticket vault 174. Furthermore, a ticket 108 purchased from an authorized retailer of the tickets 108 (dealer, game controller, etc.) at a table 170 or 170A that bears a win not paid at the table (i.e. such as a house progressive jackpot, a table jackpot, any other jackpot, etc.) may be valid only where tickets 108 are sold by an authorized retailer and where the retailer activated the ticket 108 as a live ticket 108. The win or prize is paid only if the ticket 108 holds a win and the ticket 108 has not been altered or changed. After the retailer has verified the ticket 108, the retailer pays the winner of these respective table jackpots, and the retailer or scanner software then deactivates the light features 240 and resets them on the respective circular or wager areas for a new play of the game.

Figure 24:
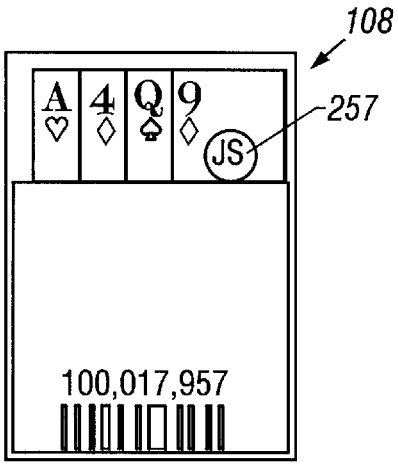
FIG. 24 is a back face embodiment of a lottery ticket for the present TRILOGYυ lottery ticket game having four playing card faces and further showing a jackpot symbol for a jackpot symbol game.
Figure 25:
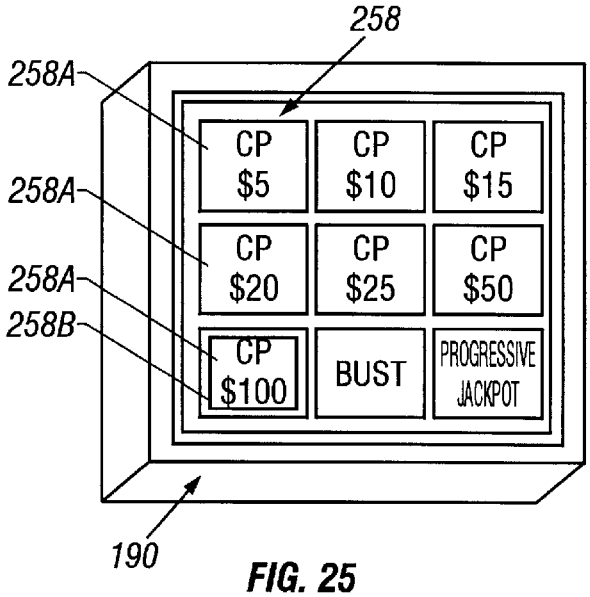
FIG. 25 is a perspective side view of an overhead monitor showing blinking lighted prize windows wherein a player stops the blinking light on a particular window in selecting a prize in the jackpot symbol game.
Figure 26:
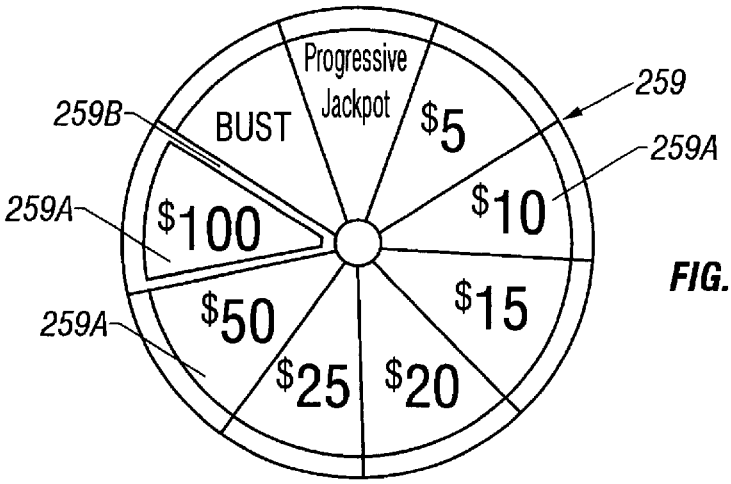
FIG. 26 is a side view of a prize wheel showing a light that rotates around or randomly moves around each prize area wherein a player stops the light on a particular prize area in selecting a prize in the jackpot symbol game.
Figure 29:
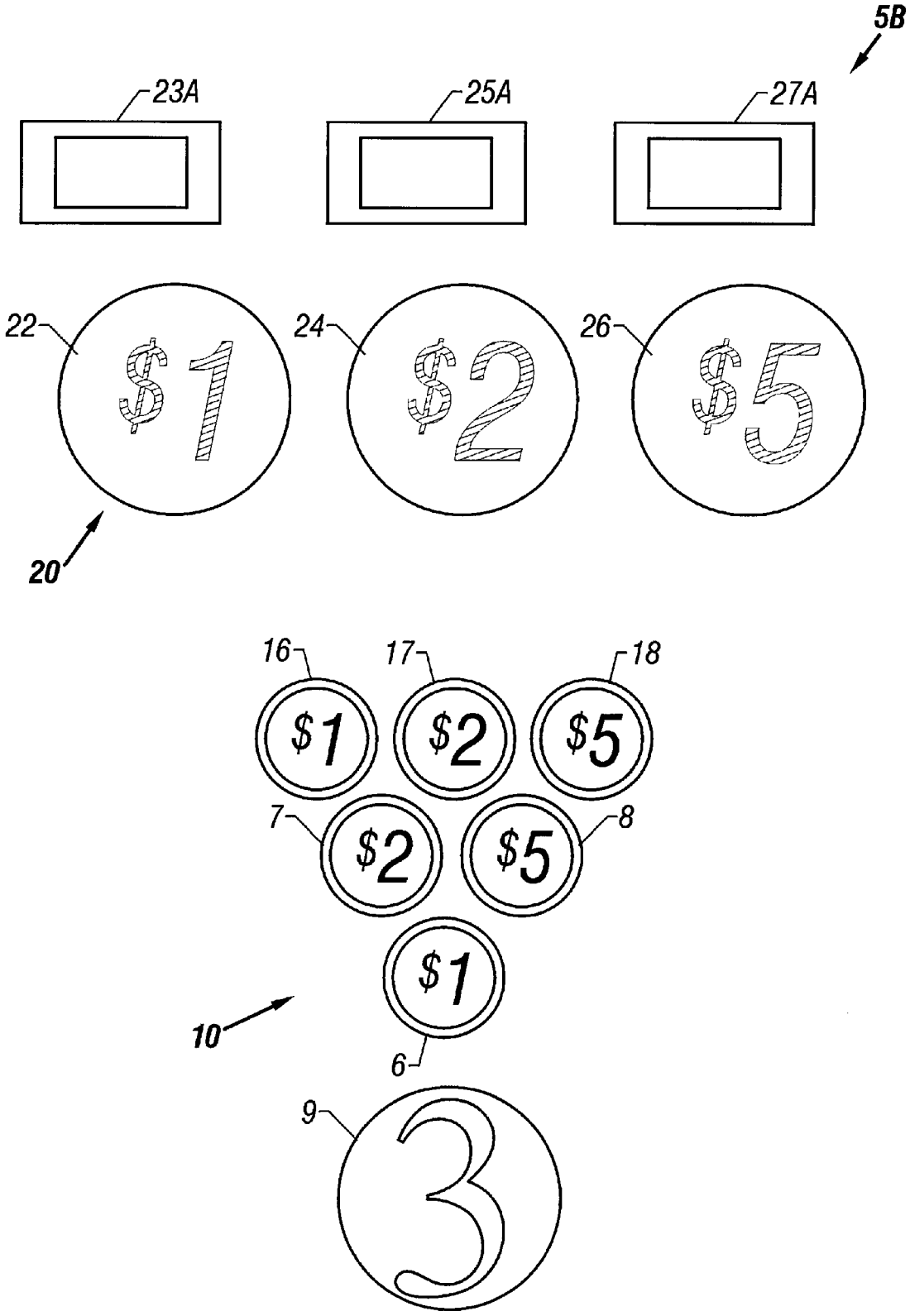
FIG. 29 is a top view of the playing field for the player of the present game which shows the buttons depressed by the player in playing the jackpot symbol game.

Additionally, in the second level 20 of play, players may win a progressive jackpot for the respective dollar amount TRILOGY™ lottery ticket 108 that the player is playing. When the table jackpot amounts for the respective TRILOGY™ lottery ticket games are determined, then a percentage of (i.e. one chip from) the table jackpot is provided to the progressive jackpot 222, 224, or 226. This percentage amount of chips from the table jackpot circular areas 22, 24, and 26 may be placed into the progressive jackpot chip drop 177 as shown in FIG. 16A. If the player has a ticket 108 that has a triple seven (i.e. 7-7-7) combination thereon, then the player wins the respective dollar amount TRILOGY™ lottery ticket jackpot 222, 224, or 226. Alternatively, the player may play a jackpot symbol game in order to win the progressive jackpot. Referring to FIGS. 24, 25, and 26, the method discloses that a TRILOGY™ lottery ticket 108 which has a jackpot symbol 257 printed thereon provides an opportunity for the player with that ticket 108 to play a jackpot symbol game in order to win the progressive jackpot. If a ticket 108 does not have the symbol 257, then the player does not have the opportunity to play for the progressive jackpot. FIG. 24 shows a ticket 108 with the jackpot symbol 257. If a ticket 108 does have the symbol 257, then the player's number 9 at the table 170 or 170A and on the overhead monitor 190 or 190A will begin to flash. FIG. 25 shows the overhead monitor 190 with monitor windows 258A wherein each window 258A has a blinking prize light 258B that will randomly blink one at a time at a predetermined rate, and FIG. 26 shows a prize wheel 259 having various prize areas 259A each area 259A having a light 259B that is able to light up and then turn off one at a time at a certain rate making it appear to the player as though the light is rotating around or randomly moving around the prize wheel 259 in a circle at a predetermined rate. The player presses the respective flashing table jackpot button 23A, 25A, or 27A as shown in FIG. 29 within a predetermined number of seconds (i.e.five (5) seconds) to stop the randomly generated blinking prize window light 258B (i.e. FIG. 25) on a particular window 258A or the rotating or randomly moving light 259B on a particular prize area 259A on the prize wheel 259 (i.e. shown in FIG. 26) reflecting to the player his/her selected prize. By timely stopping the blinking light 258B or the moving light 259B, the player may end up selecting and winning the progressive jackpot prize or a consolation prize (CP) or may select a bust window 258A or 259A in which the player wins nothing. The progressive or consolation prizes that equate to a designated prize amount may be paid at the table 170 or 170A by the retailer's dealer/game controller. The consolation prizes (CP) that are won from the jackpot symbol game are instantly deducted from the corresponding total progressive jackpot 222, 224, or 226 displayed on the overhead monitor 190 or 190A. These jackpots 222, 224, and 226 increase as additional play of the game continues until the respective jackpot is won by a player. This jackpot symbol game may be played by the player at the table 170 or 170A or at other designated locations at a later time.

For example, in FIGS. 17 and 17A, if the player has a $1.00 TRILOGY™ lottery ticket 108 that has a triple seven (i.e. 7-7-7) combination thereon, then the player wins the $1.00 game house progressive jackpot 222 which is shown as the amount of $675.00. In FIGS. 17 and 17A, if the player has a $2.00 TRILOGY™ lottery ticket 108 that has a triple seven (i.e. 7-7-7) combination thereon, then the player wins the $2.00 game house progressive jackpot 224 which is shown as the amount of $1,575.00. If the player has a $5.00 TRILOGY™ lottery ticket 108 that has a triple seven (i.e. 7-7-7) combination thereon, then the player wins the $5.00 game house progressive jackpot 226 which is shown as the amount of $4,920.00. The progressive jackpot may be a house progressive jackpot (i.e. compilation of amounts from a number of TRILOGY™ game tables 170 or 170A in a house) or a wide area progressive game (i.e. compilation of amounts from a number of tables 170 or 170A at a number of locations).

Other methods used with the present invention in determining who the winner is for the table jackpot in the second level 20 of play are disclosed as follows. These methods provide randomly printed playing cards from ace to king covering the four suits (i.e. spade, hearts, diamonds, clubs) of regular playing cards on the backs of the TRILOGY™ lottery tickets 108 such as shown in FIGS. 18 to 21. Various playing card games, such as the ones disclosed below, are used to determine the winner for the table jackpot in the second level 20. Therefore, the game must be played by at least a minimum of two persons (i.e. one or more players playing against the dealer/house as a house banked game or two or more players playing against each other in order to avoid play of a house-banked game).

Other monitors are used in conjunction with the present invention so that the dealer, the players, and other viewers are able to monitor and view play of the game. FIG. 16A shows a monitor 179 for the dealer (i.e. dealer monitor 179). The dealer monitor 179 allows the dealer to monitor the players and play of the game as it progresses. The dealer monitor 179 aids the dealer in knowing which tickets 108 need to be provided to which players. The dealer monitor 179 may display the tickets 108 being purchased/dispensed by the corresponding players and indicates to the dealer the corresponding win amounts. The dealer monitor 179 is able to display the color lights 245A or 245B for the color coding scheme 247. The dealer monitor 179 also flags players that have not satisfied the contingency of the first level 10 of play in order to enter the second level 20 of play.

FIGS. 17 and 17A show electronic monitors 190 and 190A for the players and other viewers. These monitors 190 and 190A are typically mounted overhead so that the players/viewers are able to easily monitor and view play of the game. FIG. 17 is a display of the table 170 and the corresponding play in FIG. 16 while FIG. 17A is a display of the table 170A and the corresponding play in FIG. 16A. These monitors 190 and 190A show the tickets 108 being purchased/dispensed by the corresponding players and/or indicate the respective win amounts shown. The bar code 158 of each ticket 108 is read by a scanner as the ticket 108 is dispensed by the ticket dispenser 172, and the monitor 190 or 190A displays indices on the front face of the ticket 108 and/or the corresponding win amounts. Therefore, players do not necessarily have to remove the coverings on the tickets 108 in order to find out whether or not they are winners since the monitor 190 or 190A is able to display this information for the players/viewers. Additionally, after reading the bar code(s) 158, the scanner sends the ticket information to the house computer, which, in turn, sends the information to a host computer. Also, the monitors 190 and 190A are able to display the color lights 245A or 245B for the color coding scheme 247 in determining whether he/she is a winner and the amounts that he/she has won. The monitors 190 and 190A are able to indicate the players that have not satisfied the contingency of the first level 10 of play in order to enter the second level 20 of play.

B. Second Embodiment of TRILOGY™ Multiple Level Game (High/Low Playing Card Game).

Figure 18:
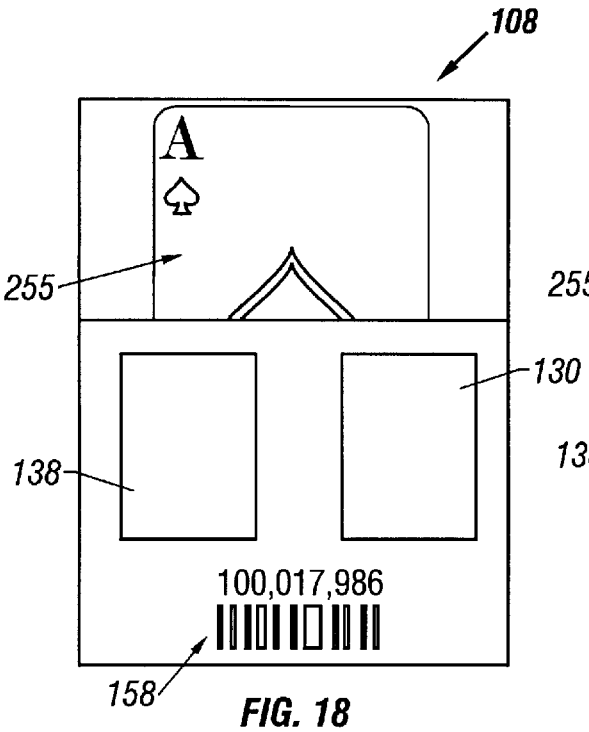
FIG. 18 is a back face embodiment of a lottery ticket for the present TRILOGY™ lottery ticket game having one playing card face.
Figure 27:
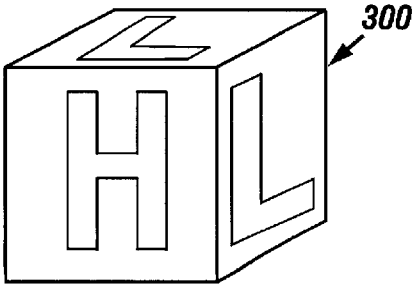
FIG. 27 is a perspective side view of a die for used for determining play of a high or low playing card game.
Figure 28:
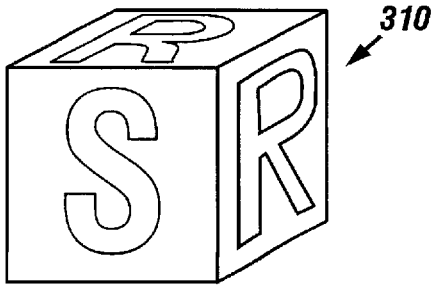
FIG. 28 is a perspective side view of a die used for determining whether the table jackpot should split or ride.

A second embodiment of the TRILOGY™ lottery ticket game having multiple levels of game play is identical to the first embodiment except that the method of determining the winner for the table jackpot (i.e. circular areas 22, 24, or 26) is different. Instead of determining the winner of the table jackpot in the second level 20 on the highest TRILOGY™ ticket 108, a high/low playing card game is used. Referring to FIGS. 27 and 28, two dice 300 and 310 are initially used before playing the high/low playing card game. The die 300 has the letters H and L imprinted thereon wherein the roll of a H represents a High card game that is to be played and the roll of a L represents that a Low card game is to be played. The die 310 has the letters S and R imprinted thereon. The roll of a S on the die 310 represents that the table jackpot is to be split among the players in the event of a tie, and the roll of a R on the die 310 represents that the table jackpot is to ride to the next round of play in the event of a tie. Alternatively, cards may be used to determine whether the jackpot is split or rides. Referring to FIG. 18, a back of a TRILOGY™ ticket 108 shows a playing card face 255 randomly printed thereon (i.e. can be any card from ace to king and of any suit). The back of the ticket 108 shows some of the general areas as stated before such as area 130 that defines the jackpot wins, area 138 that defines the instant wins, and bar codes 158. FIG. 18 shows the playing card face 255 as the ace of spades (i.e. the highest playing card face). A high/low playing card game is used to determine who wins the table jackpot in the second level 20 of play from the respective jackpot circular area 22, 24, or 26 for the respective dollar amount TRILOGY™ ticket 108. Either the highest or lowest card may be used to determine the respective winner. In other words, the player with the highest playing card face 255 wins the corresponding table jackpot if a highest playing card game is used, and the player with the lowest playing card face 255 wins the corresponding table jackpot if a lowest playing card game is used. Any ties in the high/low playing card game splits (i.e. S is rolled on die 310) or pushes/rides (i.e. R is rolled on die 310) the respective table jackpot until that jackpot is won by one player. Therefore, the game must be played by a minimum of at least two persons (i.e. one or more players playing against the dealer/house as a house banked game or two or more players playing against each other in order to avoid play of a house-banked game).

C. Third Embodiment of TRILOGY™ Multiple Level Game (Closest to 21 Playing Card Game). (A Game of Skill or Chance)

Figure 19:
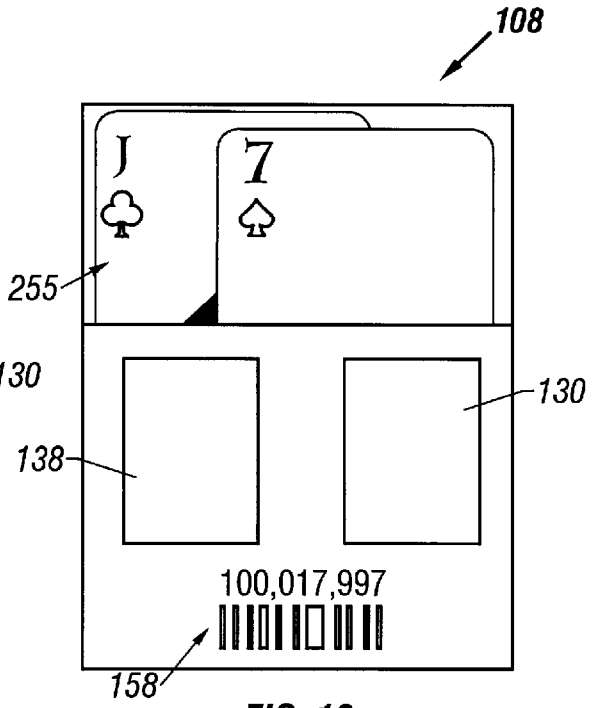
FIG. 19 is a back face embodiment of a lottery ticket for the present TRILOGY™ lottery ticket game having two playing card faces.

A third embodiment of the TRILOGY™ lottery ticket game having multiple levels of game play uses a closest to twenty-one (21) playing card game to determine the winner for the table jackpot (i.e. circular areas 22, 24, or 26). The die 310 has the letters S and R imprinted thereon, and the die 310 is initially rolled. The roll of a S on the die 310 represents that the table jackpot is to be split among the players in the event of a tie, and the roll of a R on the die 310 represents that the table jackpot is to ride/push to the next round of play in the event of a tie. Alternatively, cards may be used to determine whether the jackpot is split or rides. Referring to FIG. 19, a back of a TRILOGY™ ticket 108 shows two playing card faces 255 randomly printed thereon (i.e. can be any card from ace to king and of any suit or a wild card or joker, etc.). The back of the ticket 108 may show some of the general areas as stated before such as area 130 that defines the jackpot wins, area 138 that defines the instant wins, and bar codes 158. A closest to 21 playing card game is used to determine who wins the table jackpot in the second level 20 of play from the respective jackpot circular area 22, 24, or 26 for the respective dollar amount TRILOGY™ ticket 108. Therefore, the player with the highest cards 255 closest to 21 wins the table jackpot in the second level 20 of play from the respective jackpot circular area 22, 24, or 26 for the respective dollar amount TRILOGY™ ticket 108. Any ties in the closest to 21 playing card game splits (i.e. S is rolled on die 310) or pushes/rides (i.e. R is rolled on die 310) the respective table jackpot until that jackpot is won by one player. Therefore, the game must be played by a minimum of at least two persons(i.e. one or more players playing against the dealer/house as a house banked game or two or more players playing against each other in order to avoid play of a house-banked game). Alternatively, the two playing card faces 255 on the ticket 108 as shown in FIG. 19 could be used to play a regular 21 playing card game wherein the player may request and receive additional card(s) from an outside deck(s) in order to play out the regular 21 card game.

D. Fourth Embodiment of TRILOGY™ Multiple Level Game (5 Card Stud Poker Playing Card Game). (A Game of Skill)

Figure 20:
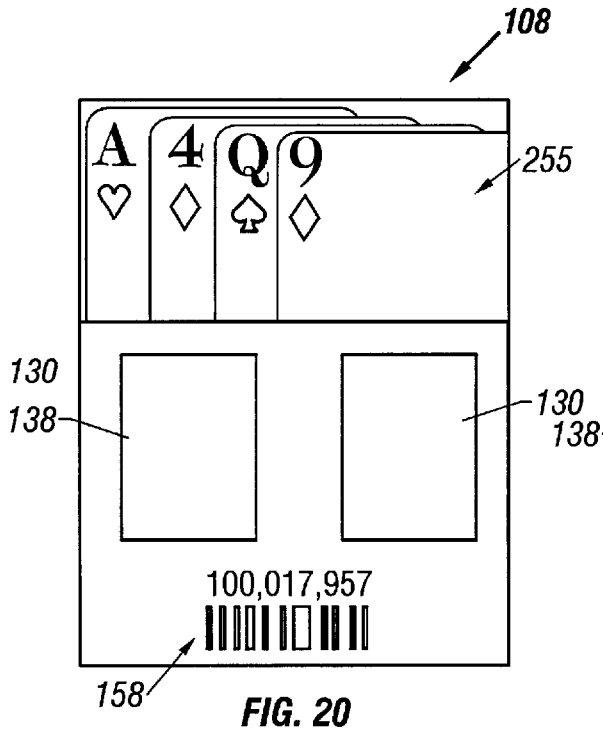
FIG. 20 is a back face embodiment of a lottery ticket for the present TRILOGY™ lottery ticket game having four playing card faces.

A fourth embodiment of the TRILOGY™ lottery ticket game having multiple levels of game play uses a five (5) card stud poker playing card game to determine the winner for the table jackpot (i.e. circular areas 22, 24, or 26). Referring to FIG. 20, a back of a TRILOGY™ ticket 108 shows four playing card faces 255 randomly printed thereon (i.e. can be any card from ace to king and of any suit or a wild card or joker, etc.). The back of the ticket 108 may show some of the general areas as stated before such as area 130 that defines the jackpot wins, area 138 that defines the instant wins, and bar codes 158. The die 310 may have the letters S and R imprinted thereon, and the die 3 10 is initially rolled. The roll of a S on the die 310 represents that the table jackpot is to be split among the players in the event of a tie, and the roll of a R on the die 310 represents that the table jackpot is to ride/push to the next round of play in the event of a tie. Alternatively, cards or other methods may be used to determine whether the jackpot is split or rides.

A 5 card stud poker playing card game is used to determine who wins the table jackpot in the second level 20 of play from the respective jackpot circular area 22, 24, or 26 for the respective dollar amount TRILOGY™ ticket 108. One or more cards may be dealt face up or down by the dealer to each player playing the second level 20 of game play, and any one of the cards dealt to the player may be used with the four playing card faces 255 on the ticket 108 to make a five card hand. The table is then open at which time players may fold or bet on his/her poker hand against the other players for the respective game in the second level 20 of game play. Each table jackpot in circular areas 22, 24, and 26 respectively builds with each corresponding table jackpot bet. This game is played in the same manner as normal five card stud poker except a five of a kind would be considered the highest winning hand. When the one card is flipped over, the player with the highest poker hand wins the table jackpot in the second level 20 of play from the respective jackpot circular area 22, 24, or 26 for the respective dollar amount TRILOGY™ ticket game. Any ties in the 5 card stud poker playing card game splits (i.e. S is rolled on die 310) or pushes/rides (i.e. R is rolled on die 310) the respective table jackpot until that jackpot is won by one player. Therefore, the game must be played by a minimum of one player playing against the dealer/house as a house banked game, or the game must be played by a minimum of two players in order to avoid play of a house-banked game.

E. Fifth Embodiment of TRILOGY™ Multiple Level Game (5 Card Stud Poker Playing Card Game). (A Game of Skill).

Figure 21:
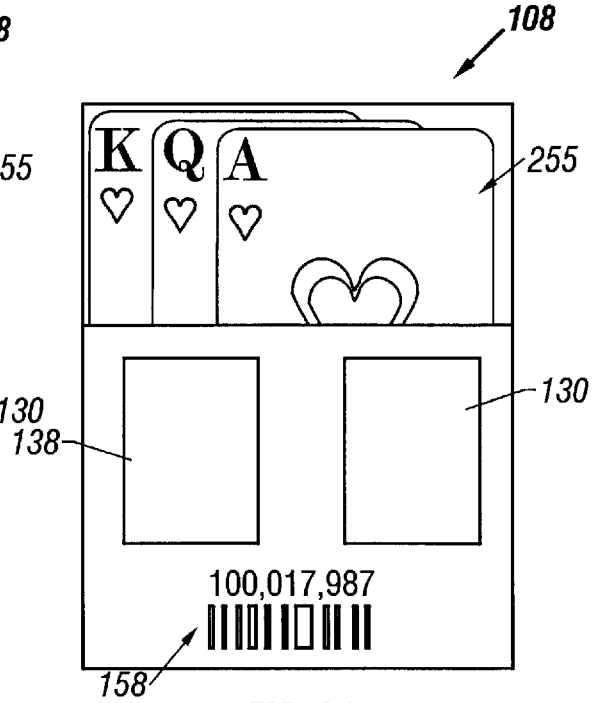
FIG. 21 is a back face embodiment of a lottery ticket for the present TRILOGY™ lottery ticket game having three playing card faces.

A fifth embodiment of the TRILOGY™ lottery ticket game having multiple levels of game play uses a five (5) card stud poker playing card game to determine the winner for the table jackpot (i.e. circular areas 22, 24, or 26). Referring to FIG. 21, a back of a TRILOGY™ ticket 108 shows three playing card faces 255 randomly printed thereon (i.e. can be any card from ace to king and of any suit). The back of the ticket 108 may show some of the general areas as stated before such as area 130 that defines the jackpot wins, area 138 that defines the instant wins, and bar codes 158. The die 310 may be initially rolled. As stated earlier, the roll of a S on the die 3 10 represents that the table jackpot is to be split among the players in the event of a tie, and the roll of a R on the die 310 represents that the table jackpot is to ride/push to the next round of play in the event of a tie. Alternatively, cards or other methods may be used to determine whether the jackpot is split or rides.

A 5 card stud poker playing card game is used to determine who wins the table jackpot in the second level 20 of play from the respective jackpot circular area 22, 24, or 26 for the respective dollar amount TRILOGY™ ticket 108. Two or more cards may be dealt face up or face down to the player or the players' "community card pool". Each player plays his/her three cards on the back of ticket 108 and any two cards dealt from a standard deck of cards to the player or the players' community card pool to make a five card poker hand, or two or more cards are dealt face up or down by the dealer to each player playing the second level 20 of game play and any two cards dealt may be used with the three playing card faces 255 on the ticket 108 to make a five card hand. The table is then open at which time players may fold or bet on his/her poker hand against the other players for the respective game in the second level 20 of game play. Each table jackpot in circular areas 22, 24, and 26 respectively builds with each corresponding table jackpot bet. This game is played in the same manner as normal five card stud poker except a five of a kind would be considered the highest winning hand. When the two cards are flipped over, the player with the highest poker hand wins the table jackpot in the second level 20 of play from the respective jackpot circular area 22, 24, or 26 for the respective dollar amount TRILOGY™ ticket game. Any ties in the 5 card stud poker playing card game splits (i.e. S is rolled on die 310) or pushes/rides (i.e. R is rolled on die 310) the respective table jackpot until that jackpot is won by one player. Therefore, the game must be played by a minimum of at least two persons (i.e. one or more players playing against the dealer/house as a house banked game or two or more players playing against each other in order to avoid play of a house-banked game).

F. Various Other Embodiments of TRILOGY™ Multiple Level Game

Various other embodiments of the TRILOGY™ multiple level game, and many other variations of the game for determining the winner(s) of the second level 20 of play exist. For example, other playing card games, such as Draw Poker, Omaha Hi/Lo, Hi/Lo Stud, and Texas Hold 'Em, etc. may be used with the present invention. Other suitable games, such as various dice games, may also be used. The present invention is not in any way limited to the particular game or games disclosed in this specification, and any suitable game or games may be used with the present invention. In particular, the present invention is not in any way limited to the particular game or games for determining the winner for the second level 20 of game play, and any suitable game that determines a single winner for the second level 20 of game play may be used with the present invention. In Sections III(D) and (E) of this specification, two examples of a 5 card stud poker game were disclosed. However, many variations of a poker game may be played using different numbers of playing card faces 255 on the ticket 108 along with various numbers of cards dealt either face up or down to play various versions of poker.

G. Electronic Version of TRILOGY™ Multiple Level Game

Figure 22:
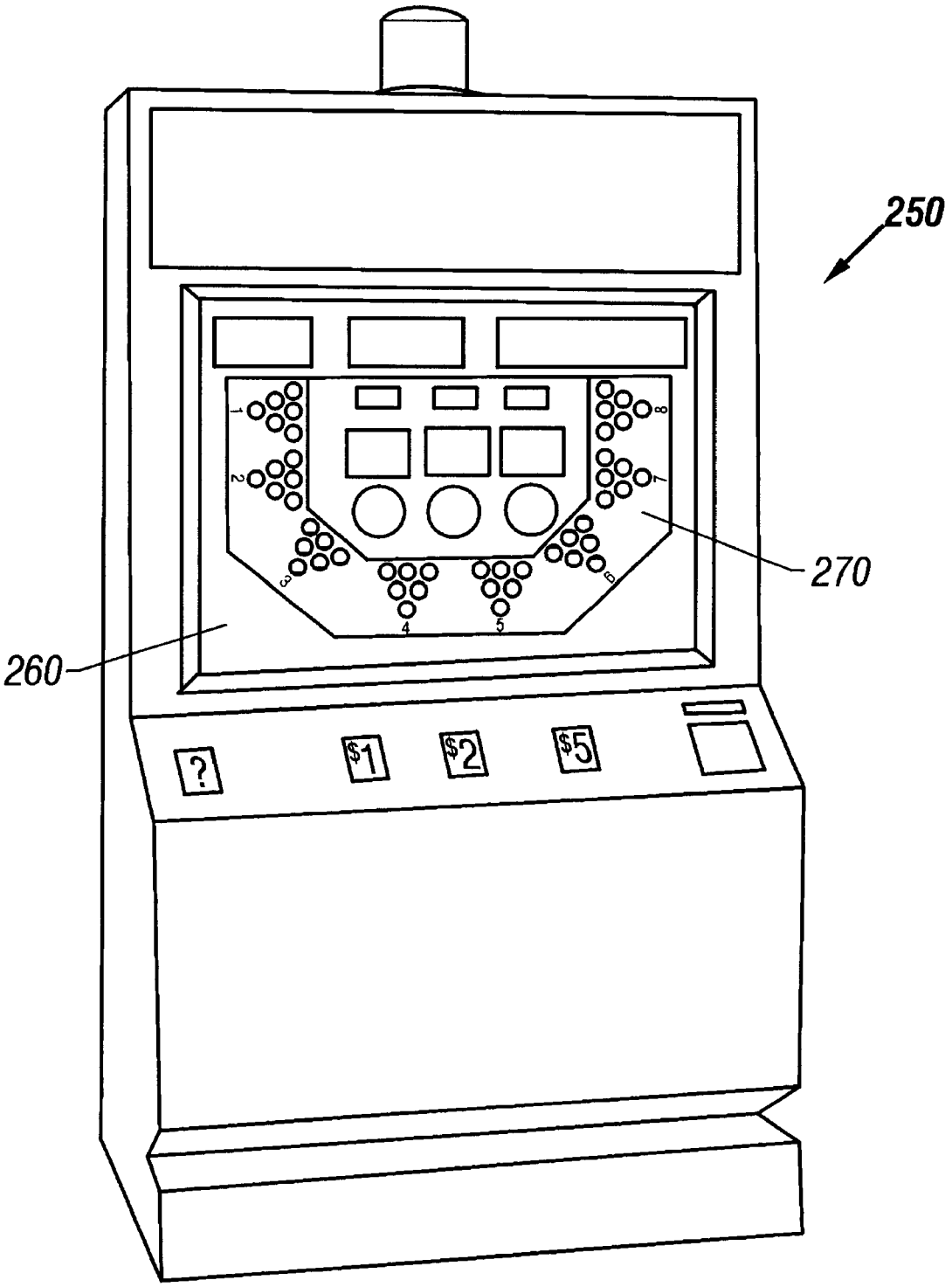
FIG. 22 is a perspective view of an electronic embodiment unit for a player of the present invention multiple incentive/multiple level game.
Figure 23:
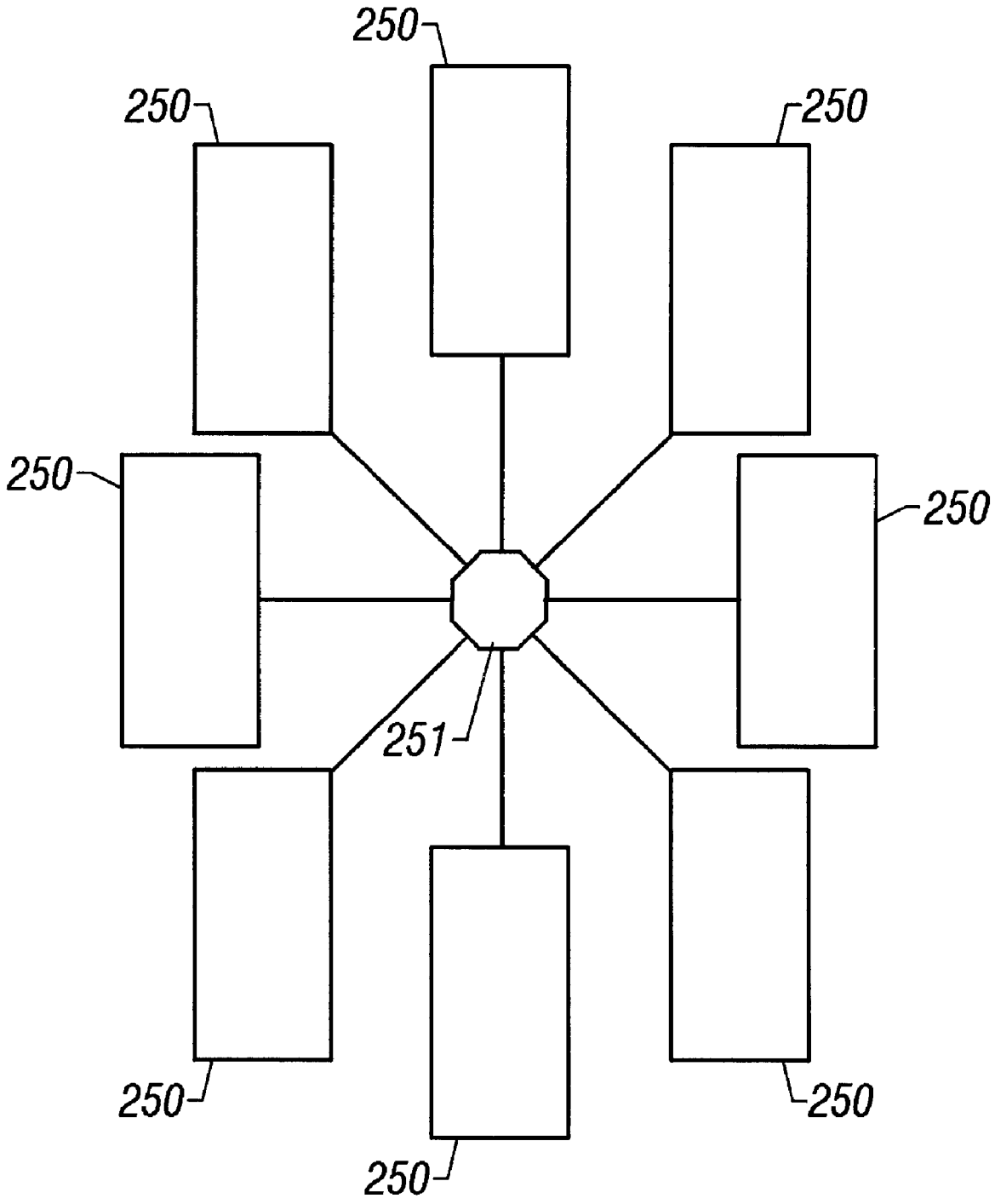
FIG. 23 is a top view diagram of a number of electronic units of FIG. 22 coupled and networked together to a central computer.

FIG. 22 shows that an electronic machine 250 may be used in conjunction with the TRILOGY™ lottery ticket game. The machine 250 may be a dispensing apparatus for the tickets 108. The machine 250 reads the bar codes 158 of the tickets 108 as they are being dispensed. The machine 250 has a screen 260 that shows a simulated TRILOGY™ multiple level game table display 270 similar to the table 170 in FIG. 16 or the table 170A in FIG. 16A. The table display 270 shows the play of the player standing at the electronic machine 250 as well as all of the other players at other electronic machines 250. Referring to FIG. 23, a number of electronic machines 250 are networked together via a central computer 251 so that a number of players are able to play the TRILOGY™ multiple level game. The TRILOGY™ multiple level game is played in the same manner as the manual version (i.e. with dealer) except that the dealer is the computer and all of the features are handled electronically. Therefore, in the electronic version, the game is played by a minimum of one person and the computer.

The machine 250 may dispense the tickets 108, or it may be able to display the playing indices 111 and the winning indicators 124, 126, and 128 on the front side of the ticket 108 being read. The machine 250 may be a fully electronic version wherein the TRILOGY™ lottery ticket game is played electronically and no tickets 108 are dispensed. The machine 250 is also able to display the winner, the respective winning indices, and winning amounts for the first level 10 and second level 20 of game play. The TRILOGY™ multiple level game is not limited to implementation as to what has just been described, and any suitable implementation may be used to carry out the TRILOGY™ multiple level game.

H. House Payment

The house may collect revenues from players in two ways. The first way is for the house to collect the difference of the ticket sale price less a percentage (i.e. such as 80%) of total amount of ticket price allocated for prizes to the players. The house pays all of its costs and expenses including ticket paper and license fees incurred by the house from its remaining percentage (i.e. such as 20%) of the ticket sale price. The second way is for the house to collect a percentage (i.e. such as 50%) of each progressive jackpot drop generated from the table jackpot. The house pays all of its costs and expenses incurred including game license fee, costs incurred by the house for the ticket game(s) and card game(s) and software communications from its percentage.

The preferred embodiment of the invention is described above in the Figures and Detailed Description. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to applicant at the time of filing the application has been presented for the purposes of illustration and description. It is not intended to be exhaustive or to limit the invention to the precise form disclosed, and many modifications and variations are possible in the light of the above teaching. The embodiment was chosen and described in order to best explain the principles of the invention and its practical application and to enable others skilled in the art to best utilize the invention in various embodiments and with various modifications as are suited to the particular use contemplated.

What is claimed is:

1. A method of playing a game comprising the steps of:

entering and playing, by a player, a lottery ticket game at a first level of game play that provides incentive to a player to play the game, entering and playing, by the player, at least one jackpot game in which one player is determined a winner at a second level of game play that provides further incentive to the player to play the game, determining whether the player has decided to enter the second level of game play, playing the first level of game play and winning accordingly when the player decides only to play the first level of game play, determining whether the player has satisfied contingencies to play the second level of game play, playing only the first level of game play and winning accordingly if the contingencies to play the second level of game play have not been met by the player, and playing the first level and second level of game play and winning accordingly if the contingencies to slay the second level of game play have been met by the player, and wherein the at least one jackpot game at the second level of game play further comprises a table jackpot game that is played among at least two persons in which one of the at least two persons is determined a winner of a corresponding table jackpot amount and a progressive jackpot game that builds from the play of the table jackpot game wherein a winning player of the progressive jackpot game is determined by results of the lottery ticket game.

2. The method of playing the game according to claim 1 further comprising the steps of:

determining whether the player has decided to play the game again, starting the game again if the player has decided to play again, and ending the game if the player has decided to quit playing the game.

3. The method of playing the game according to claim 1 wherein the table jackpot game further comprises:

a highest lottery ticket game wherein the player with a highest lottery ticket wins the corresponding table jackpot.

4. The method of playing the game according to claim 1 wherein the table jackpot game further comprises:

a playing card game wherein the player that is a winner of the playing card game wins the corresponding table jackpot.

5. The method of playing the game according to claim 4 wherein the playing card game further comprises:

a high card game wherein the player having a highest playing card wins the corresponding table jackpot.

6. The method of playing the game according to claim 4 wherein the playing card game further comprises:

a low card game wherein the player having a lowest playing card wins the corresponding table jackpot.

7. The method of playing the game according to claim 4 wherein the playing card game further comprises:

a twenty one card game wherein the player having a hand closest to twenty one wins the corresponding table jackpot.

8. The method of playing the game according to claim 4 wherein the playing card game further comprises a poker card game wherein the player having a winning poker hand wins the corresponding table jackpot.

9. The method of playing the game according to claim 1 wherein the table jackpot game further comprises:

a dice game wherein the player that is a winner of the dice game wins the corresponding table jackpot.

10. The method of playing the game according to claim 1 wherein:

the entering and playing, by a player, a lottery ticket game at a first level of game play step further comprises the step of entering and playing the lottery ticket game to provide smaller win amounts, and the entering and playing, by the player, at least one jackpot game in which one player is determined a winner at a second level of game play step further comprises the step of entering and playing the at least one jackpot game to provide larger win amounts.

11. The method of playing the game according to claim 10 wherein:

the first and second levels of game play are a lottery game, the smaller win amounts are instant win amounts for at least one instant win game of the lottery game, and the larger win amounts are progressive win amounts for at least one progressive win game of the lottery game.

12. The method of playing the game according to claim 11 wherein:

the instant win amounts are won by having particular winning indices on a lottery ticket for the at least one instant win game, and the progressive win amounts are won by having particular indices on a lottery ticket for the at least one progressive win game and the at least one instant win game.

13. The method of playing the game according to claim 12 further comprising the step of:

printing a number of lottery tickets for a number of decks of the lottery tickets, printing winning indices on some of the lottery tickets for the at least one instant win game, printing at least one winning indices on a lottery ticket within each of the decks of lottery tickets for the at least one progressive win game, randomly printing at least one corresponding winning indices for the at least one instant win game of a lottery ticket having the at least one winning indices for the at least one progressive win game on a corresponding play line in determining a winner for the at least one progressive win game, providing a number of decks for a deal of the lottery tickets, allowing a progressive jackpot of the at least one progressive win game to continuously build as more decks and deals of the lottery tickets are added and sold to players, determining respective win amounts for the instant win amounts and the progressive win amounts to the players at time of purchase of the lottery tickets, and resetting the progressive jackpot to an initial jackpot amount when the winner for the at least one progressive win game has been determined.

14. The method of playing the game according to claim 13 further comprising the step of:

electronically playing the game.

15. A method of making a game with multiple incentives and multiple levels comprising the steps of:

defining at least one game and at least one win opportunity for one level of game play that provides incentive to a player to play the game, defining at least another game and at least another win opportunity for at least another level of game play that provides further incentive to the player to play the game, implementing corresponding game components for the one level and the another level of game play, and defining contingencies of the at least one game for the one level of game play in order to enter and play the at least another game for the at least another level of game play, and wherein the at least one game and the at least another game are gambling games, wherein one of the gambling games for the at least one game is a lottery ticket game and at least one of the gambling games for the at least another game is at least one jackpot game, and wherein the at least one jackpot game further comprises a table jackpot game that is played among at least two persons in which one of the at least two persons is determined a winner of a corresponding table jackpot amount and a progressive jackpot game that builds from the play of the table jackpot game wherein a winning player of the progressive jackpot game is determined by results of the lottery ticket game.

16. A game with multiple incentives and multiple levels comprising the steps of:

a first level game that is a lottery ticket game with win opportunities that provides incentive to a player to play the game, at least a second level game that is at least one jackpot game with win opportunities that provides further incentive to the player to play the game, game components for implementing and playing the first and second level games, and a game table that comprises a lottery play area for allowing each of a number of players to play the lottery game and a jackpot game play area for allowing each of the players to play the at least one jackpot game and a jackpot area that retains chip amounts collected from the jackpot game play area from each of the players.

17. The game with multiple incentives and multiple levels according to claim 14 further comprising:

contingencies of the first level game that need to be satisfied in order to enter and play the at least second level game.

18. The game with multiple incentives and multiple levels according to claim 16 wherein the lottery ticket game further comprises:

at least one instant win game that provides the player with at least one win opportunity for an instant win amount, and at least one progressive win game that provides the player with at least one win opportunity for a progressive jackpot amount.

19. The game with multiple incentives and multiple levels according to claim 18 wherein the lottery ticket game further comprises:

a lottery ticket with the at least one instant win game, the at least one progressive win game, and the corresponding play and winning indices printed thereon.

20. The game with multiple incentives and multiple levels according to claim 19 wherein:

the at least one jackpot game is a playing card game, and the lottery ticket also has playing card indices printed thereon for play of the playing card game.

21. The game with multiple incentives and multiple levels according to claim 19 further comprises:

at least one bar code for reading the play and winning indices on the lottery ticket and for monitoring and tracking and identifying a winning ticket and accordingly resetting the progressive jackpot amount.

22. The game with multiple incentives and multiple levels according to claim 16 wherein:

the lottery play area comprises a number of lottery wager areas for each of the players, and the jackpot game play area comprises a number of jackpot wager areas for each of the players.

23. The game with multiple incentives and multiple levels according to claim 16 further comprising:

a ticket vault and dispenser for holding and dispensing lottery tickets for the lottery game, a bar code reader for reading the lottery tickets a s the lottery tickets are being dispensed, and a computer coupled to the ticket vault and dispenser and the bar code reader for monitoring and tracking play of the game.

24. The game with multiple incentives and multiple levels according to claim 23 further comprising:

a dealer monitor coupled to the computer to allow a dealer to monitor and track play of the game.

25. The game with multiple incentives and multiple levels according to claim 23 further comprising:

a player monitor coupled to the computer to allow players and other viewers to view play of the game.

26. The game with multiple incentives and multiple levels according to claim 16 wherein the game components for implementing and playing the first and second level games are fully electronic game components.

27. The game with multiple incentives and multiple levels according to claim 26 wherein the fully electronic game components are electronic player units coupled together to a computer.

28. The method of playing the game according to claim 1 wherein the at least two persons are at least two players playing to be the winner of the corresponding table jackpot amount.

29. The method of playing the game according to claim 1 wherein the at least two persons are at least one player and a house dealer playing to be the winner of the corresponding table jackpot amount.

30. The method of playing the game according to claim 1 wherein the progressive jackpot game is a jackpot symbol game wherein an imprinted symbol on a lottery ticket provides a player at least one opportunity to win a prize amount.

31. The game with multiple incentives and multiple levels according to claim 19 further comprises:

a jackpot symbol is imprinted on the lottery ticket which symbolizes an opportunity for the player to play and win a prize amount.

32. The game with multiple incentives and multiple levels according to claim 22 further comprising:

at least one play tracking component coupled to the lottery play area and to the jackpot game play area for tracking play made by each of the players.

33. The game with multiple incentives and multiple levels according to claim 32 wherein the at least one play tracking component further comprises:

a light and sensor component located at each of the lottery wager areas and the jackpot wager areas, a wager activation switch coupled to each light and sensor component wherein the switch is activated to light up the lottery wager areas and the jackpot wager areas where a chip is sensed on one of the respective lottery wager areas and the respective jackpot wager areas, and a flashing light component coupled to the light and sensor component wherein a light feature of the light and sensor component is flashed at a respective winning lottery wager area and a respective jackpot wager area.

34. The game with multiple incentives and multiple levels according to claim 33 further comprising:

colored lights located at the lottery wager areas and the jackpot wager areas where activation of the colored lights represent respective win amounts for the lottery ticket game.

35. A game with multiple incentives and multiple levels comprising the steps of:

a first level game that is a lottery ticket game with win opportunities that provides incentive to a player to play the game, at least a second level game that is at least one jackpot game with win opportunities that provides further incentive to the player to play the game, and game components for implementing and playing the first and second level games, wherein the lottery ticket game further comprises at least one instant win game that provides the player with at least one win opportunity for an instant win amount, at least one progressive win game that provides the player with at least one win opportunity for a progressive jackpot amount, and a lottery ticket with the at least one instant win game, the at least one progressive win game, and the corresponding play and winning indices printed thereon, and wherein the game further comprises at least one bar code for reading the play and winning indices on the lottery ticket an d for monitoring and tracking and identifying a winning ticket and accordingly resetting the progressive jackpot amount.

* * * * *